US005273585A

United States Patent [19]

Shoga et al.

[11] Patent Number: 5,273,585

[45] Date of Patent: Dec. 28, 1993

[54] HEAT-TREATING APPARATUS

[75] Inventors: Hideo Shoga, Yamaguchi; Yoshikazu Nagai, Hiroshima; Masayuki Suzawa, Hiroshima; Hiroshi Nagahama, Hiroshima; Ko Yamaoka, Hiroshima; Teiji Ogawa; Yoshitugu Kamiya, both of Nara, all of Japan

[73] Assignee: Mazda Motor Corporation, Hiroshima, Japan

[21] Appl. No.: 676,082

[22] Filed: Mar. 27, 1991

[30] Foreign Application Priority Data

| | | | |
|---|---|---|---|
| Mar. 27, 1990 | [JP] | Japan | 2-79575 |
| Mar. 27, 1990 | [JP] | Japan | 2-79576 |
| Mar. 29, 1990 | [JP] | Japan | 2-35211[U] |
| Mar. 29, 1990 | [JP] | Japan | 2-35212[U] |
| Mar. 29, 1990 | [JP] | Japan | 2-35213[U] |

[51] Int. Cl.[5] ..... C23C 16/00

[52] U.S. Cl. ..... 118/719; 118/724; 118/725; 165/58

[58] Field of Search ..... 118/719, 724, 725; 165/58

[56] References Cited

U.S. PATENT DOCUMENTS 5,002,009 3/1991 Hayami ..... 118/724

FOREIGN PATENT DOCUMENTS 62-021866 5/1987 Japan .
62-118167 7/1987 Japan .
63-210287 8/1988 Japan .

*Primary Examiner*—Richard Bueker
*Attorney, Agent, or Firm*—Thompson, Hine and Flory

[57] ABSTRACT

A heat-treating apparatus comprises zones such as a carburizing zone, a cooling zone, and a nitriding zone, those zones are formed in series by partitioning a continuous passage through doors, and conveyance means for conveying an object along the passage. The cooling zone comprises a forced-feed cooling means for cooling the object by blowing cooling gas.

15 Claims, 17 Drawing Sheets

HEAT-TREATING APPARATUS

The present invention relates to a heat-treating apparatus, particularly, to a heat-treating apparatus having a heat-treating zone where an object is heat-treated in controlled atmosphere.

As shown in the Japanese Patent Publication Gazette No. 62-21866 and the Japanese Utility Model Registration Laying Open Gazette No. 62-118167, the known heat-treating apparatus is that an object composed of steel member, etc., is kept under high temperature in carburizing gas atmosphere and the object is quenched thereafter. A heat-treating apparatus in the Japanese Patent Publication Gazette No. 62-21866 is provided as entering zone, a carburizing zone, a temperature down zone, and a quenching zone in series and doors are provided between those zones. A heat-treating apparatus in the Japanese Utility Model Registration Laying Open Gazette No. 62-118167 is provided a gas carburizing part and a quenching part. The gas carburizing part has a heating zone, a carburizing zone, and a diffusion zone. The quenching part has a rapid cooling zone, which cools an object by cooling pipes, and a quenching zone having a quenching tank.

However, the above both heat-treating apparatuses cannot process the carbonitriding process, even some heat treatment cases need carbonitriding process which an object finished being carburized is heated in the nitriding gas atmosphere and it is quenched thereafter in order to improve the quenching.

When a carbonitriding process is needed, as shown in the Japanese Patent Application Laying Open Gazette No. 63-210287, an object is cooled after being heated in a carburizing furnace in the carburizing gas atmosphere which can be carbon potential, then the object is heated in a nitriding furnace in the nitriding gas atmosphere which can be predetermined carbon potential and nitrogen potential, the object is quenched thereafter.

A heat-treating cycle of the above case is as shown in FIGS. 20 and 21. In details, as shown in FIG. 20, an object is heated to a temperature of approximately 800° C.~900° C., and the object is carburized in a carburizing furnace under keeping the temperature at approximately 900° C.~950° C., thereafter the object is cooled down in the carburizing furnace, and finally the object is took out of the furnace when the temperature is dropped to approximately 350° C. Next, as shown in FIG. 21, the object is re-heated to a temperature of approximately 850° C.~870° C. and soaked at this temperature, then the temperature of the object is dropped to a temperature of approximately 820° C.~840° C., then the object is carbonitrided under keeping the temperature at approximately 820° C.~840° C. in a carbonitriding furnace, the object is quenched thereafter.

However, as shown in the Japanese Patent Application Laying Open Gazette No. 63-210287, such a method that an object carburized in a carburizing furnace is cooled inside or outside of the furnace, then the object is re-heated and carbonitrided in a carbonitriding furnace, thereafter the object is quenched possesses disadvantages such as poor operational efficiency and large energy loss.

Such a method that an object carburized in a carburizing furnace is quenched, then the object is nitrided in a nitriding furnace and thereafter the object is again quenched can improve the operational efficiency. However, this method possesses a problem that the object is deformed by being quenching two times.

On the other hand, an object is not cooled evenly and rapidly in such a method that the object is cooled by cooling pipes as shown in the Japanese Utility Model Registration Laying Open Gazette No. 62-118167. Therefore, the inventors of the present invention tried to utilize a cooling gas in order to cool the object in a cooling zone in a heat-treating apparatus. Thus, a heat-treating apparatus, according to the present invention, comprises a heat-treating zone for heat-treating an object in the controlled atmosphere and a cooling zone for cooling the object, which finished being heat-treated in the heat-treating zone, by the cooling gas, and those the heat-treating zone and the cooling zone communicate through a door.

However, when the door is opened and the object heated in the heat-treating zone is conveyed to the cooling zone, pressure in the cooling zone is raised by the radiant heat from the high temperatured object. Accordingly, the cooling gas supplied in the cooling zone flows into the heat-treating zone, and the density of the controlled atmosphere in the heat-treating zone is changed. Consequently, there exists a problem that the quality of the object is badly affected.

When cooling of the object is started after the object is finished being conveyed into the cooling zone and the door is closed, the pressure in the cooling zone is reduced according to the dropping of the temperature of the object. This results in causing problems such as lowered quality of the object caused by the controlled atmosphere leaked from the heat-treating zone to the cooling zone through a little space around the door, an explosion by air, i.e., $O_2$, leaked into the cooling zone through a little space of a wall of the cooling zone, and another lowered quality of the object by decarburization caused by $O_2$ entered into a joint of the object.

The object of the present invention is to operate a series of process, which the object is cooled after being carburized and quenched after being carbonitrided, efficiently without energy loss.

Another object of the present invention is to prevent lowering the quality of the object and the explosion in the cooling zone, in such a heat-treating apparatus that a heat-treating zone for heat-treating the object in the controlled atmosphere and a cooling zone for cooling the object by the cooling gas communicate to each other through a door.

SUMMARY OF THE INVENTION

A heat-treating apparatus, according to the present invention, comprises a carburizing zone, a cooling zone, a nitriding zone, and conveyor means for conveying an object along a passage in the above order, those zones are formed by partitioning the passage by doors and the the cooling zone comprises forced-feed cooling means for cooling an object.

According to the above structure, when the object is carbonitrided, the object can be nitrided in a nitriding zone without being taken out of the furnace if the temperature of the object carburized in the carburizing zone dropped to a desired temperature. Furthermore, since the cooling zone comprises the forced-feed cooling means, the time for cooling the object can be saved. Consequently, according to the heat-treating apparatus of the present invention, such series of process that the object is cooled after being carburized, then the object is quenched after being carbonitrided, can be carried out efficiently without energy loss.

Moreover, the heat treatment system according to the present invention comprises a heat-treating zone where the object is heat-treated in the controlled atmosphere and a cooling zone where the object finished being heat-treated is cooled by the cooling gas, both the heat-treating zone and the cooling zone communicate through a door, and the cooling zone comprises pressure regulating means for regulating the pressure inside the cooling zone. Therefore, the pressure in the cooling zone is regulated to the same level as the pressure in the heating zone, i.e., there is no pressure difference between the cooling zone and the heating zone. Consequently, the controlled gas doesn't leak from the heating zone to the cooling zone and the cooling gas in the cooling zone doesn't leak to the heating zone. This results in prevention of lowering the quality of the object since the controlled gas density in the heating zone doesn't change and also results in prevention of an explosion since the external air, i.e., $O_2$, doesn't leak to the cooling zone by that the pressure in the cooling zone is not lowered.

DESCRIPTION OF THE PREFERRED EMBODIMENT

The preferred embodiment is described below with reference to the accompanying drawings.

Figure 1A:
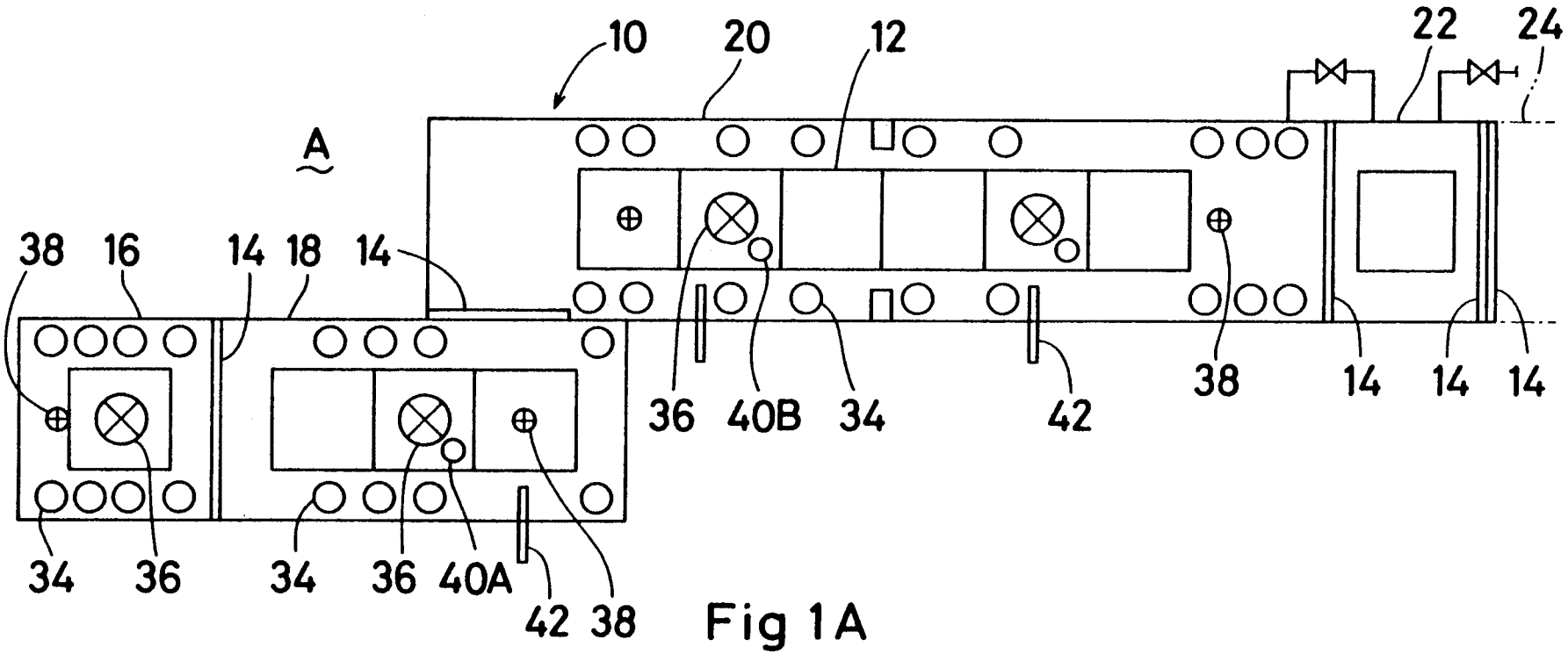
FIGS. 1A and 1B are schematic plan views of a heat-treating apparatus according to the present invention.
Figure 1B:
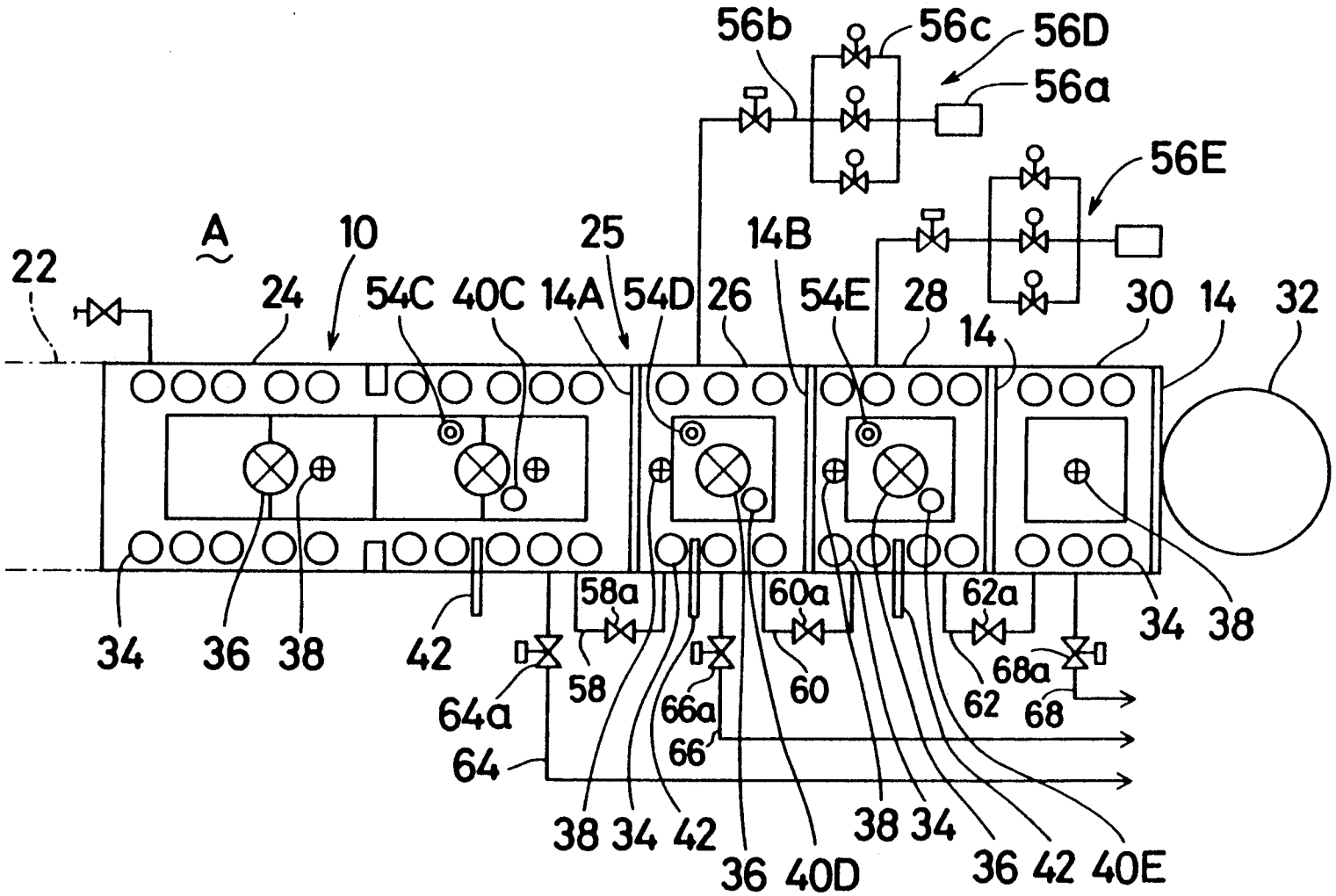

FIGS. 1A and 1B show schematic plan views of a heat-treating apparatus A according to the present invention. In the heat-treating apparatus A, a palette 12 having an object thereon is conveyed from the left to the right in a tunnel typed continuous furnace 10, which has a passage extending transversely, by a power roller which is conveyor means.

The continuous furnace 10 is partitioned by a plurality of openable/closable doors 14 and comprises a degreasing chamber 16, a temperature up chamber 18 as temperature up zone, a carburizing chamber 20 as a carburizing zone and a heat-treating zone, a cooling chamber 22 as a cooling zone, a temperature re-up chamber 24 as a temperature re-up zone, a temperature down chamber 26 and a carbonitriding chamber 28 both as a nitriding zone, and a extraction vestibule 30 from the left. A double door 14 is provided between the cooling chamber 22 and the temperature re-up chamber 24 in order to strengthen the sealing of the chambers. Also, a salt tank 32 is provided adjacent to a continuous furnace 10 to its right.

The degreasing chamber 16 is a zone for degreasing process, i.e., removing grease coated on the surface of the object. The degreasing process is carried out in order to prevent an unappropriate heat treatment, for example, unappropriate carburizing process, caused by polluted controlled atmosphere by evaporation of the grease on the object. In order to process the degreasing process when the object is heated, the degreasing chamber 16 comprises an electro tube 34 which is a heater for raising the chamber temperature to approximately 700° C.~800° C., a stirring fan 36 for stirring the heated air, and a thermocouple 38 which is a temperature sensor for detecting the temperature of the degreasing chamber 16.

The temperature up chamber 18 is a zone for preheating the object degreased already, and it comprises the electro tube 34 for raising the chamber temperature to approximately 900° C.~950° C. in order to heat the object, a converted gas inlet 40A for supplying converted gas (mixed gas of air and $C_4H_{10}$) which is carburizing gas obtained by a converting method in the furnace in order to prevent oxidation and decarburization, a sample tube 42 having $O_2$ sensor detecting oxygen density of the temperature up chamber 18 for sampling the controlled gas, the stirring fan 36, and the thermocouple 38, those last two are as describe in the above.

A carburizing chamber 20 is a zone for carburizing, i.e., for pack cementation of C (carbon) on the surface of the object, and it comprises the electro tube 34 for raising the chamber temperature to approximately 900° C.~950° C., a converted gas inlet 40B for supplying the converted gas for pack cementation of C on the surface of the object, the stirring fan 36, the thermocouple 38, and the sample tube 42, those last threes are as described in the above.

Figure 2:
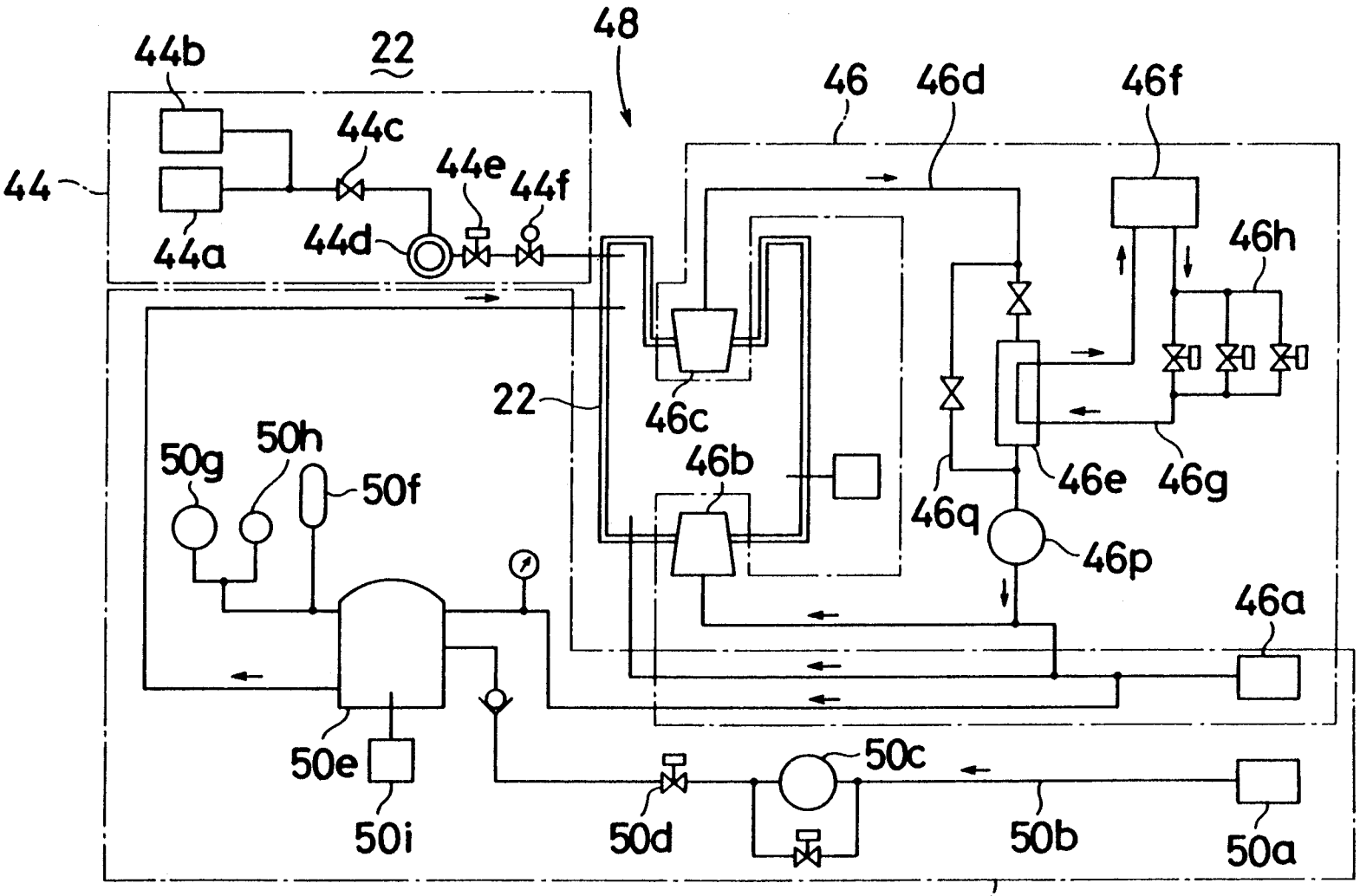
FIG. 2 is a diagrammatic view of a cooling chamber of the heat-treating apparatus according to the present invention.

The cooling chamber 22 is a zone for forcibly cooling the object finished being carburized. The cooling chamber 22, as shown in FIG. 2, comprises converted gas supplying means 44 for supplying the converted gas into the cooling chamber 22, gas cooling means 46 which is forced-feed cooling means for cooling the object by blowing the cooling gas, and pressure regulating means 48 for regulating the pressure inside the cooling chamber 22.

The above converted gas supplying means 44 comprises pressure air supplying means 44a for supplying an excess air, a butane supplying source 44b for supplying $C_4H_{10}$ which is stock gas, a mixing valve 44c for forming the converted gas by mixing the excess air and $C_4H_{10}$, a ring burner 44d for burning $O_2$ contained in the converted gas so as to prevent $O_2$ from leaking to the cooling chamber 22, a flow mass regulating valve 44e for regulating the flow mass of the converted gas, and a pressure reducing valve 44f for preventing rising of a pressure in the cooling chamber 22 by releasing the cooling gas in the cooling chamber 22 to the outside.

As described above, since the heat-treating apparatus A comprises the converted gas supplying means 44 in the cooling chamber 22, oxidation and decarburization can be prevented when the object is cooled.

The above gas cooling means 46 comprises a nitrogen supplying source 46a for supplying the $N_2$ gas which is cooling gas, a cooling gas blowing duct 46c for blowing the cooling gas to the object, a cooling gas collecting duct 46c for collecting the cooling gas blown to the object, a cooling gas circulating passage 46d having a circulating pump 46p and a bypass 46q where the cooling gas circulates, a heat exchanger 46e for cooling the collected cooling gas, a refrigerant supplying source 46f for supplying refrigerant to the heat exchanger 46e, a refrigerant circulating passage 46g where the refrigedrant circulates between the refrigerant supplying source 46f and the heat exchanger 46e, and a bypass 46h composed essentially of a plurality of passages having various diameters and provided in the refrigerant circulating passage 46g for regulating the flow mass of the refrigerant.

As shown in the above, since the heat-treating apparatus A comprises the gas cooling means 46 in the cooling chamber 22, it can speed up the cooling rate to 108° C.~30° C./minute from 6° C./minute of the conventional furnace cooling. Therefore, it takes 4~11 minutes to cool the object from the temperature of approximately 900° C.~950° C. to the temperature of approximately 500° C. Thus, cooling after carburizing can be processed efficiently.

Also, since the object doesn't need to be quenched after being carburized due to the rapid cooling after being carburized, the heat deformation of the object which is caused by being quenched after the carburizing is prevented.

The pressure regulating means 48 comprises aforementioned a pressure reducing valve 44f and pressure means 50 described hereinafter.

The period of operation of the pressure reducing valve 50f can be set from right after the object is conveyed to the cooling chamber 22 until a predetermined period of time passes since it, or can be set on the basis of a signal from a pressure sensor provided in the cooling chamber 22.

The pressure means 50 comprises an endothermic gas supplying source 50a for supplying endothermic gas which is the carburizing gas, an endothermic gas inlet passage 50b for making the endothermic gas flow into the cooling chamber 22, a booster 50c, provided in the endothermic gas inlet passage 50b, for boosting the endothermic gas pressure, a flow mass regulating valve 50d for regulating flow mass of the endothermic gas flowing the endothermic gas inlet passage 50b, a pressure tank 50e for storing the endothermic gas boosted its pressure, a relief valve 50f for preventing the pressure inside a pressure tank 50e from going over a predetermined level, a pressure sensor 50g for detecting the pressure of the pressure tank 50e, a pressure meter 50h for showing the pressure inside the pressure tank 50e, and an $O_2$ sensor 50i for detecting the oxygen density inside the pressure tank 50e. The pressure of the cooling chamber 22 is boosted by supplying the endothermic gas in the pressure tank 52e to the cooling chamber 22.

As mentioned above, since the heat-treating apparatus A comprises the pressure regulating means 48 having the pressure reducing valve 44f and the pressure means 50 in the cooling chamber 22, the pressure of the cooling chamber 22 is prevented from being boosted by the pressure reducing valve 44f when the pressure of the cooling chamber 22 is boosted by the high temperatured object conveyed from the carburizing chamber 20 to the cooling chamber 22. Thus, the object is prevented from being badly affected by the cooling gas which flows to the carburizing chamber 20 from the cooling chamber 22 and then causes the density change of the carburizing gas density in the carburizing chamber. Also, the pressure of the cooling system 22 is prevented from being lowered by the pressure means 50 when the temperature of the object in the cooling chamber 22 is dropped and the pressure of the cooling chamber 22 may be also dropped. Thus, the bad affection of the object and an explosion of the cooling chamber 22, those are caused by the leaking of the carburizing gas from the carburizing chamber 20 to the cooling chamber 22 or the leaking of $O_2$ from the outside of the cooling chamber 22 into inside of it, are prevented. The period of operation of the pressure means 50 is set from right after the object is conveyed into the cooling chamber 22 and the door 14 is closed until a predetermined period of time passes since that, or can be set on the basis of a signal from the pressure sensor.

Figure 3:
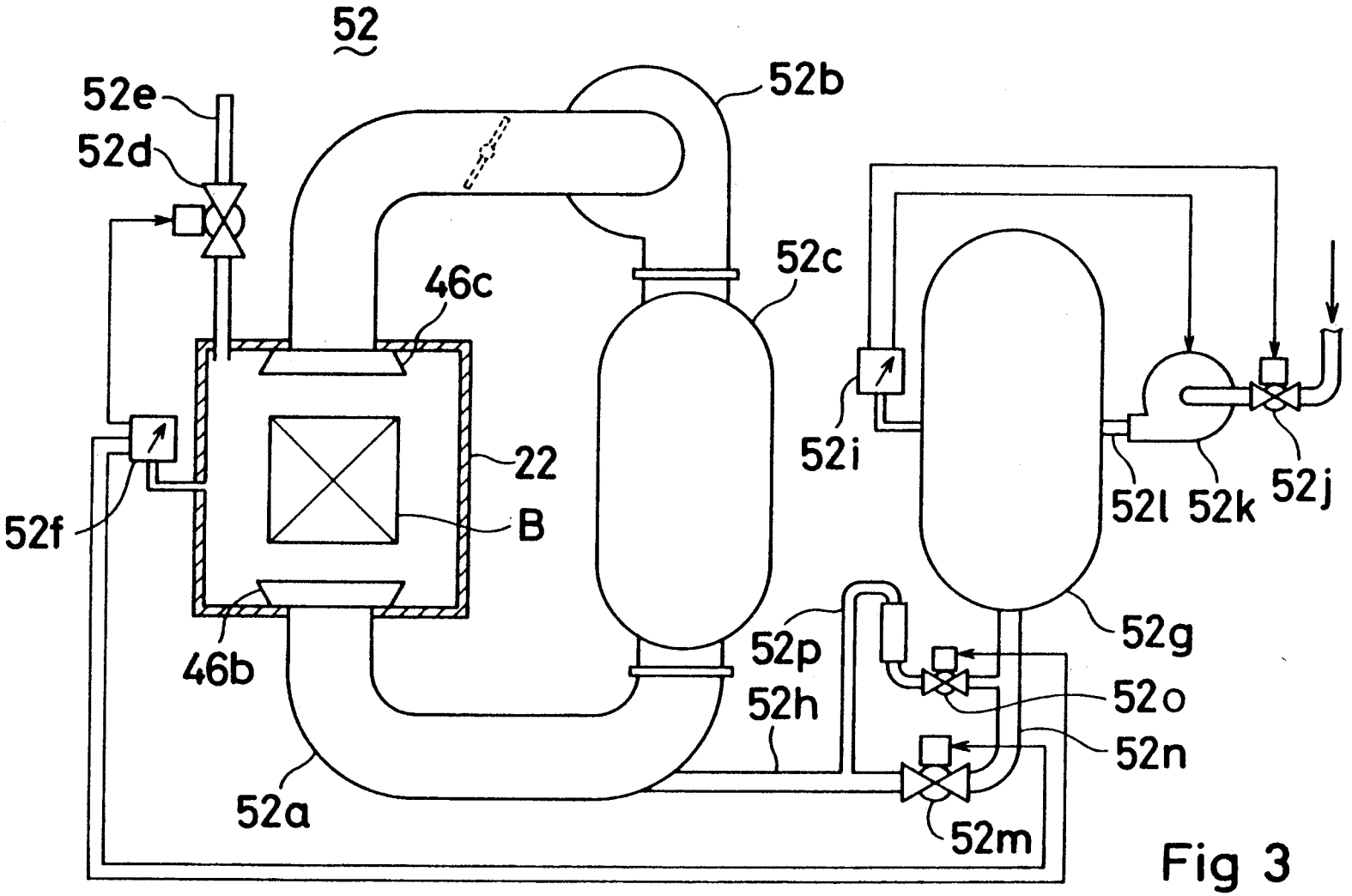
FIG. 3 is a diagrammatic view of pressure regulating means, provided in a cooling chamber, as a modified embodiment.

FIG. 3 illustrates pressure regulating means 52 which is a modified embodiment of the above pressure regulating means 48. This pressure regulating means 52 utilizes the converted gas, which is used for the carburizing, for the cooling gas after it is cooled.

As shown in FIG. 3, the pressure regulating means 52 comprises a circulating duct 52a for circulating the converted gas by communicating the cooling gas blowing duct 46b and the cooling gas collecting duct 46c. A fan 52b and a converted gas cooling heat exchanger 52c are provided in the circulating duct 52a. The converted gas collected through the cooling gas collecting duct 46c after being cooled by the converted gas cooling heat exchanger 52c is blown to the object B in the cooling chamber 22 from the cooling gas blowing duct 46b. As shown in FIG. 3, the pressure regulating means 52 comprises converted gas exhausting vent 52e having a vent valve 52d, a first pressure switch 52f provided in the cooling chamber 22, a reserve tank 52g for storing the converted gas, a communicating tube 52h for communicating the circulating duct 52a and the reserve tank 52g, a second pressure switch **52*i* provided in the reserve tank 52*g*, and a converted gas inlet tube 52*l* having a converted gas supplying valve 52*j* and a pressure pump 52*k* for supplying the converted gas to the reserve tank 52*g*. The communicating tube 52*h* is bifurcated into a large mass of gas supplying passage 52*n* of a large diameter having a large mass of gas supplying valve 52*m* and a small mass of gas supplying passage 52*p*** of a small diameter having a small mass of gas supplying valve.

Figure 4:
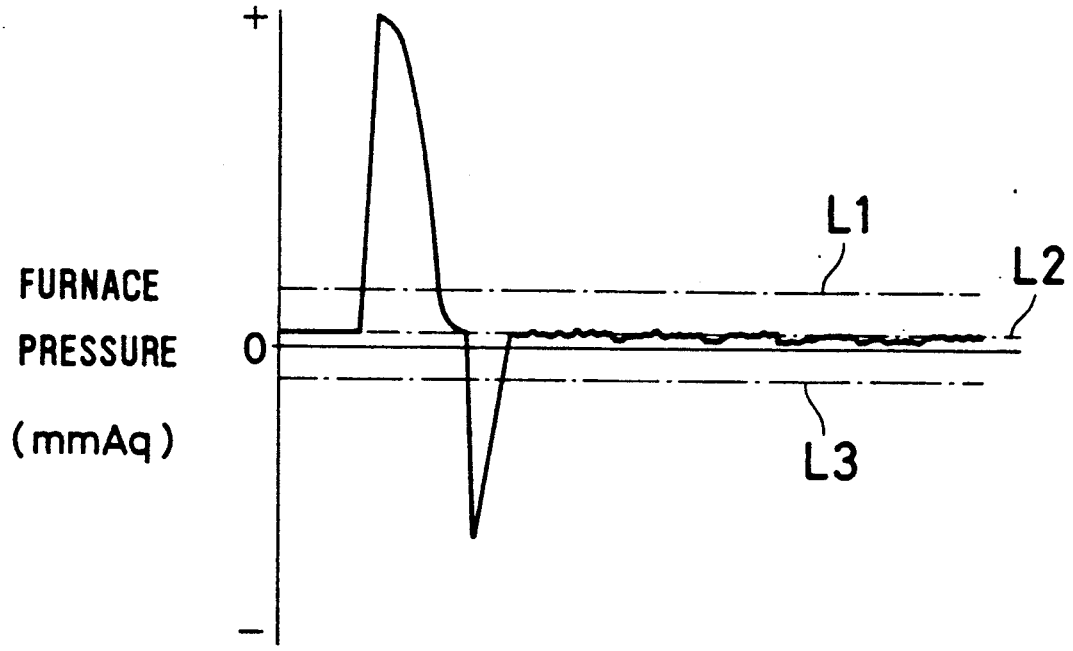
FIG. 4 is a diagram illustrating a furnace pressure change in a cooling chamber having the modified pressure regulating means in FIG. 3.

The setting of the first pressure switch **52*f* is described below in reference to FIG. 4**.

The first pressure switch **52*f* opens the vent valve 52*d* when the pressure of the cooling chamber 22 is raised and reaches to a high level (L1) of the positive pressure. The first pressure switch 52*f* closes the vent valve 52*d* and opens the large mass of gas supplying valve 52*n* when the pressure of the cooling chamber 22 is reduced and reaches to a low level (L3) of the negative pressure. Also, the first pressure switch 52*f* closes the large mass of gas supplying valve 52*n* when the pressure of the cooling chamber 22 reaches to a middle level (L2) of the positive pressure, which is lower than the high level (L1), from the negative pressure. The first pressure switch 52*f* opens the small mass of gas supplying valve 52*o* when the pressure of the cooling chamber 22 is reduced to a lower level than the middle level (L2) from a higher level than the middle level (L2), and closes the small mass of gas supplying valve 52*o* when the pressure of the cooling chamber 22** is raised to the higher level than the middle level (L2) from the lower level than the middle level (L2).

The second pressure switch **52*i* is set to open the converted gas supplying valve 52*j* when the pressure of the reserve tank 52*g* is reduced and closes the converted gas supplying valve 52*j* when the pressure of the reserve tank 52*g*** is accumulated.

Figure 5:
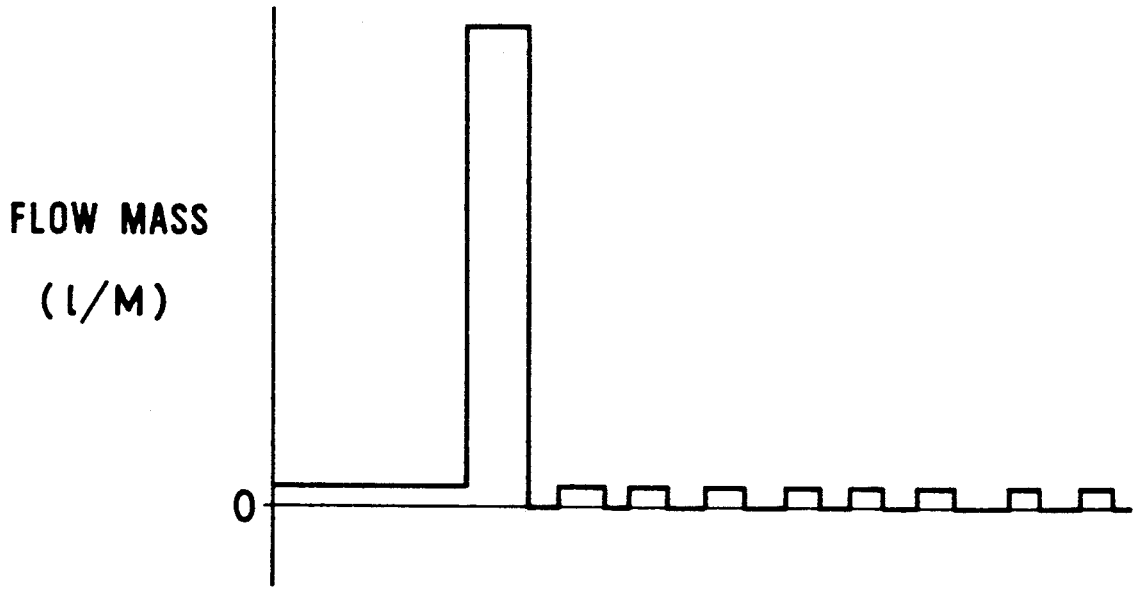
FIG. 5 is a diagram illustrating a flow mass of converted gas in the pressure regulating means in FIG. 3.

The pressure change inside the cooling chamber 22 and the operation of the pressure regulating means 52 is described below. FIG. 5 is illustrating the flow mass of the converted gas supplied to the cooling chamber 22.

Before the object B finished being carburized is brought into the cooling chamber 22, there is the converted gas in the cooling chamber 22 and the pressure of the cooling chamber 22 is kept at the middle level (L2). When the object B is brought into the cooling chamber 22 from the carburizing chamber 20 after the door 14 between the carburizing chamber 20 and the cooling chamber 22 is opened, the pressure of the cooling chamber 22 is rapidly raised and go over the high level (L3) since the controlled atmosphere of the cooling chamber 22 is heated. Then, the first pressure switch **52*f* is operated to open the vent valve 52*d*. Thus, the pressure of the cooling chamber 22** is reduced.

Next, when the door 14 is closed, the inside of the cooling chamber 22 is cooled and the pressure of the cooling chamber 22 is reduced to be negative pressure. When the pressure of the cooling chamber 22 is reduced to the low level (L3), the vent valve **52*d* is closed by the first pressure switch 52*f* and the large mass of gas supplying valve 52*m* is opened. The large mass of converted gas is supplied to the cooling chamber 22, resulting in the recovering the pressure of the cooling chamber 22. When the pressure of the cooling chamber 22 is recovered to the middle level (L2), the large mass of gas supplying valve 52*m* is closed by the first pressure switch 52*f***.

In accordance with the cooling of the object B in the cooling chamber 22, the pressure of the cooling chamber 22 is reduced. When the pressure of the cooling chamber 22 is lower than the middle level (L2), the small mass of gas supplying valve **52*o* is opened to supply the small mass of the converted gas in the cooling chamber 22 from the reserve tank 52*g*. Then, when the pressure of the cooling chamber 22 reaches to the middle level (L2), the small mass of gas supplying valve 52*o* is closed by the first pressure switch 52*f*. Thereafter, when the pressure of the cooling chamber 22 fluctuates around the middle level (L2), the small mass of gas supplying valve 52*o* is opened or closed continuously by the first pressure switch 52*f* so that the pressure of the cooling chamber 22** is maintained at the same level.

On the other hand, when the large mass of the converted gas is supplied to the cooling chamber 22 from the reserve tank **52*g*, the pressure of the reserve tank 52*g* is lowered. Then the converted gas supplying valve 52*j* is opened by the second pressure switch 52*i* and also, the pressure pump 52*k* is driven so that the converted gas inside the reserve tank 52*g* is supplied to the reserve tank 52*g*. When the pressure of the reserve tank 52*g* reaches to a predetermined reserved pressure level, the converted gas supplying valve 52*j* is closed and also, the pressure pump 52*k* is stopped so that the supply of the converted gas to the reserve tank 52*g* is stopped. Thus, the pressure of the reserve tank 52*g*** is maintained at the reserved pressure level at all times.

In the above pressure regulating means 52, the large mass of gas supplying passage **52*n* and the small mass of gas supplying passage 52*p* are provided by bifurcating the communicating tube 52*h*. However, an independent large mass of gas supplying passage 52*n* and an independent small mass of gas supplying passage 52*p*** can be provided instead of the above structure.

As shown in FIG. 1B, the temperature re-up chamber 24 is a zone for re-heating the object in order to solidify the metalic structure to austenite structure, and the temperature re-up chamber comprises the electro tube 34 for raising the temperature to approximately 850° C.~870° C., a converted gas inlet 40C, a endothermic gas inlet 54C, both for preventing oxidation and decarburization of the object, the stirring fan 36, the thermocouple 38, and the sample tube 42, the last threes are as described before.

The temperature down chamber 26 is a zone for dropping the temperature of the object to approximately 820° C.~840° C. in order to process the carbonitriding of the object which is heated in the temperature re-up chamber 24. The temperature down chamber 26, as the temperature re-up chamber 24, comprises the electro tube 34, the stirring fan 36, the thermocouple 38, the converted gas inlet 40D, the sample tube 42, and the endothermic gas inlet 54D.

Ammonia supplying means 56D for supplying $NH_3$ in order to gain the nitriding gas is connected to the temperature down chamber 26, and the ammonia supplying means 56D comprises an ammonia supplying source **56*a* for supplying $NH_3$, an ammonia inlet passage 56*b* for making $NH_3$ flow to the temperature down chamber 26, and a bypass 56*c* composed essentially of a plurality of passages of various diameters for regulating $NH_3$ flowing through the ammonia inlet passage 56*b***.

Thus, inside the temperature down chamber 26, $NH_3$ gas supplied from the ammonia supplying means 56D is added to the endothermic gas, supplied from the converted gas inlet 40D or the endothermic gas inlet 54D or the both, so as to form the carbonitriding gas and accordingly, inside of the temperature down chamber 26 becomes the carbonitriding gas atmosphere. Consequently, the object is carbonitrided in the process of dropping the temperature of the object to approximately 820° C.~840° C. in the temperature down chamber 26.

The reason for dropping the temperature of the object, which is heated to a temperature of approximately 850° C.~870° C. in the temperature re-up chamber 24, to a temperature of approximately 820° C.~840° C. in the temperature down chamber 26 is that the $NH_3$ added to endothermic gas for carbonitriding is resolved into [N] and $H_2$ at the temperature of approximately 820° C.~840° C., while metal structure of the object is not solidified to austenite structure until the temperature of the object reaches to approximately 850° C.~870° C.

The carbonitriding chamber 28 is a zone for fully carbonitriding the object by keeping the object, which temperature is dropped in the temperature down chamber 26, at a temperature of approximately 820° C.~840° C. in the carbonitriding gas atmosphere. The carbonitriding chamber 28 comprises the electro tube 34 for raising the chamber temperature to 820° C.~840° C., the stirring fan 36, the thermocouple 38, the converted gas inlet 40E, the sample tube 42, the endothermic gas inlet 54E, and the ammonia supplying means 56E, the last sevens are as described as before.

An extraction vestibule 30 is a zone for preventing the pressure and the temperature of the nitriding chamber 28 from dropping when the right side of the nitriding chamber 28, i.e., a door 14 on the salt tank 32 side, is opened in order to convey the object finished being nitrided from the continuous passage 10 to the salt tank 32. The extraction vestibule 30 comprises the electro tube 34 and the thermocouple 38, those are as described before.

The salt tank 32 is for salt quenching of the object finished being carburized, and it has the known structure.

A first bypass 58 having a passage opening/closing valve 58*a* is provided between the temperature re-up chamber 24 and the temperature down chamber 26 in order to communicate to each other, a second bypass 60 having a passage opening/closing valve 60*a* is provided between the temperature down chamber 26 and the nitriding chamber 28 in order to communicate to each other, and a third bypass 62 having a passage opening/closing valve 62*a* is provided between the nitriding chamber 28 and the extraction vestibule 30 in order to communicate to each other.

A temperature re-up chamber gas exhausting passage 64 having a passage opening/closing valve 64*a* is provided in the temperature re-up chamber 24 in order to exhaust the carburizing gas in the temperature re-up chamber 24 to an outside, a temperature down chamber gas exhausting passage 66 having a passage opening/closing valve 66*a* is provided in the temperature down chamber 26 in order to exhaust the carbonitriding gas in the temperature down chamber 26 to an outside, and an extraction vestibule gas exhausting passage 68 having a passage opening/closing valve 68*a* is provided in the extraction vestibule 30 in order to exhaust the carbonitriding gas in the extraction vestibule 30 to an outside.

Figure 6:
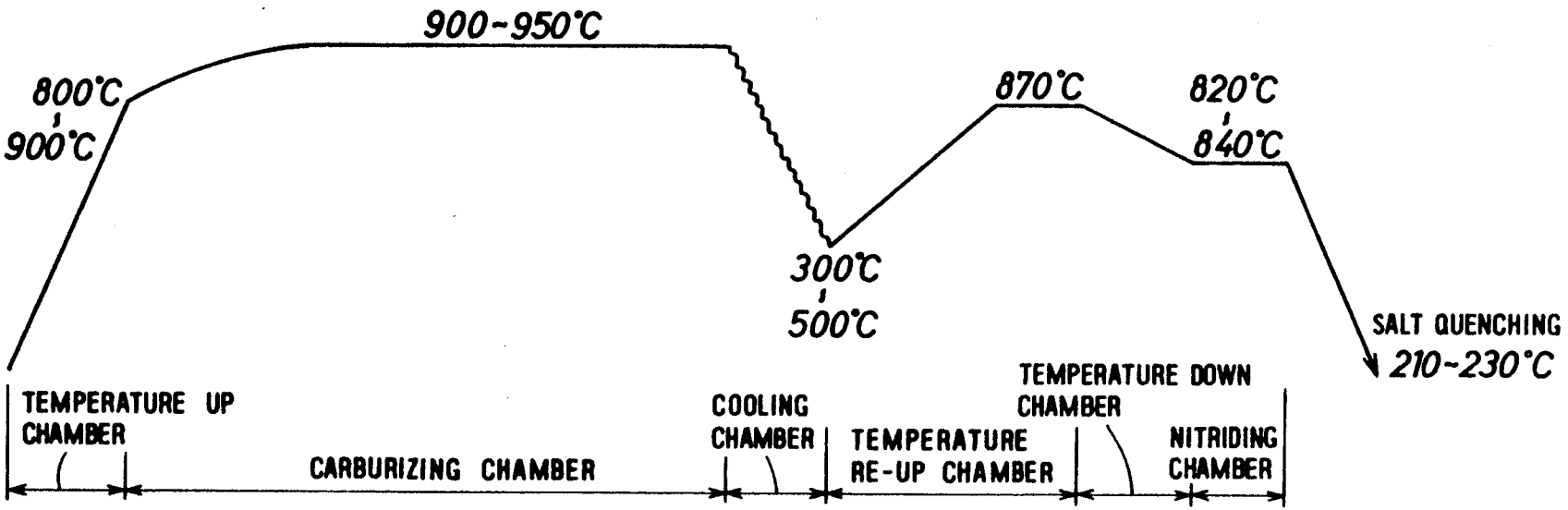
FIG. 6 is a diagram illustrating a heat-treating cycle of the present heat-treating apparatus according to the present invention.

FIG. 6 shows the heat-treating cycle of the carbonitriding process according to the present invention. As shown in FIG. 3, it follows those steps: heating the object up to a temperature of approximately 800° C.~900° C. in the temperature up chamber 18, conveying the object to the carburizing chamber 20, carburizing the object in the carburizing chamber 20 under keeping the temperature at approximately 900° C.~950° C., conveying the object to the cooling chamber 22 and cooling the object to a temperature of approximately 300° C.~500° C. in the cooling chamber 22, conveying the object to the temperature re-up chamber 24, heating the object to a temperature of approximately 870° C. in the temperature re-up chamber 24, conveying the object to the temperature down chamber 26 and cooling the object to a temperature of approximately 820° C.~840° C. in the temperature down chamber 26, conveying the object to the nitriding chamber 28 and nitriding the object in the nitriding chamber 28 under keeping the temperature at approximately 820° C.~840° C., and conveying the object to the salt tank 32 through the extraction vestibule 30 and quenching the object in the salt tank 32.

As described above, the heat-treating apparatus A according to the present invention comprises zones such as the temperature up zone, the carburizing zone, the cooling zone, the temperature re-up zone, and the nitriding zone, those zones are formed by partitioning a continuous passage by doors, and the conveyor means for conveying the object successively. From the above structure, the object which is finished being carburized can be nitrided in the nitriding zone without being taken out and accordingly, the carbonitrizing process is operated effectively. Also, since the heat-treating apparatus A comprises the cooling zone between the carburizing zone and the temperature re-up zone, the object can be heated immediately at the temperature re-up chamber when the temperature of the object is dropped to a predetermined level and consequently, there is no energy loss. Furthermore, since the cooling zone comprises the forced-feed cooling means, time for cooling the object can be saved and accordingly, the operational efficiency of the carbonitriding process will be improved. Thus, the heat-treating apparatus A can carry out the series of carbonitriding process efficiently without energy loss.

In the heat-treating apparatus A, the volume ($V_1$) of the carburizing gas supplied from the carburizing gas inlet 40C or the endothermic gas inlet 54C or the both to the temperature re-up chamber 24 is set greater than the volume ($V_2$) of the total volume of the carburizing gas supplied from the carburizing gas inlet 40D or the endothermic gas inlet 54D or the both to the temperature down chamber 26 and the nitriding gas supplied from the ammonia supplying means 56 to the temperature down chamber 26. The carburizing gas in the temperature re-up chamber 24 flows to the temperature down chamber 26 through the communicating part 25 when the door 14 between the temperature re-up chamber 24 and the temperature down chamber 26 is opened so that the communicating part 25 between the temperature re-up chamber 24 and the temperature down chamber 26 is opened. On the other hand, the carburizing gas in the temperature re-up chamber 24 flows to the temperature down chamber 26 through the first bypass 58 when the passage opening/closing valve 58*a* in the first bypass 58 is opened. Thus, air current forming means for forming air current for making the carburizing gas in the temperature re-up chamber 24 flow to the temperature down chamber 26 is constructed by the converted gas inlet 40C or the endothermic gas inlet 54C or the both, those are means for making the volume ($V_1$) of the carburizing gas in the temperature re-up chamber 24 greater than the aforementioned total volume ($V_2$) in the temperature down chamber 26.

Since the heat-treating apparatus A comprises the air current forming means, when the air current for making the carburizing gas in the temperature re-up chamber 24 flow into the temperature down chamber 26 through the communicating part 25 is formed wherein the communicating part 25 is opened by opening the door 14 between the temperature re-up chamber 24 and the temperature down chamber 26, the carbonitriding gas in the temperature down chamber 26 doesn't flow to the temperature re-up chamber 24 by obstruction by the air current, even the communicating part 25 is opened. Also, when the air current is formed for making the carburizing gas in the temperature re-up chamber 24 flow into the temperature down chamber 26 through the first bypass 58 wherein the communicating part 25 is closed by closing the door 14, the carbonitriding gas in the temperature down chamber 26 doesn't flow into the temperature re-up chamber 24 due to the air current between the temperature re-up chamber 24 and the temperature down chamber 26, even right after the communicating part 25 is opened. Since the carbonitriding gas in the temperature down chamber 26 doesn't flow into the temperature re-up chamber 24 as mentioned above, lowering the quality of the object caused by [N] in the temperature re-up chamber 24 can be prevented.

In order to make the volume ($V_1$) in the temperature re-up chamber 24 greater than the aforementioned total volume ($V_2$) in the temperature down chamber 26, either one method is taken from the following two methods: setting the pressure of gas flowing into the temperature re-up chamber 24 greater than the pressure of the gas flowing into the temperature down chamber 26, or setting the volume of the temperature re-up chamber 24 greater than the volume of the temperature down chamber 26 while setting the same gas pressure for the gas flowing to the temperature re-up chamber 24 and the temperature down chamber 26.

Also, in heat-treating apparatus A, the total volume ($V_2$) in the temperature down chamber 26 is set greater than the total volume ($V_3$) of the carburizing gas supplied from the converted gas inlet 40E or the endothermic gas inlet 54E or the both into the nitriding chamber 28 and the nitriding gas supplied from the ammonia supplying means 56 into the nitriding chamber 28. Due to the above construction, when the passage opening/closing valve **60*a* in the second bypass 60 is opened, the carbonitriding gas in the temperature down chamber 26 flows into the nitriding chamber 28 through the second bypass 60. When the passage opening/closing valve 62*a* in a third bypass 62 is opened, the carbonitriding gas in the nitriding chamber 28 flows into the extraction vestibule 30 through the third bypass 62, and thereafter the carbonitriding gas flows to the outside from the extraction vestibule 30**.

In order to set the total volume ($V_2$) in the temperature down chamber 26 greater than the aforementioned total volume ($V_3$) in the nitriding chamber 28, either one method is taken from the following two methods: differentiate the gas pressure for the gas flowing into the temperature down chamber 26 from the gas flowing into the temperature down chamber 26 from the gas flowing into the nitriding chamber 28, or setting the volume of the temperature down chamber 26 set greater than the volume of the nitriding chamber 28 while the gas pressure is set at the same level for both gas flowing into the temperature down chamber 26 and flowing into the nitriding chamber 28.

The heat-treating apparatus A is operated as described below when the object is conveyed from the temperature re-up chamber 24 to the temperature down chamber 26. The door 14 between the temperature re-up chamber 24 and the temperature down chamber 26 is referred to a bringing-in door 14A and the door 14 between the temperature down chamber 26 and the nitriding chamber 28 is referred to a bringing-out door 14B for convenience.

First of all, when the object is finished dropping its temperature in the temperature down chamber 26, the bringing-out door 14B is opened and the object is conveyed to the nitriding chamber 28, and thereafter the bringing-out door 14B is closed after this conveyance is finished. In this way, the volume of the carbonitriding gas in the temperature down chamber 26 increases by the inflow of the carbonitriding gas from the nitriding chamber 28. Therefore, as shown in the peak 1 in FIG. 4, the residual $NH_3$ gas increases rapidly. Since the $NH_3$ gas is resolved into $N_2$ and $H_2$ as the time passes, the residual $NH_3$ gas decreases.

Figure 7:
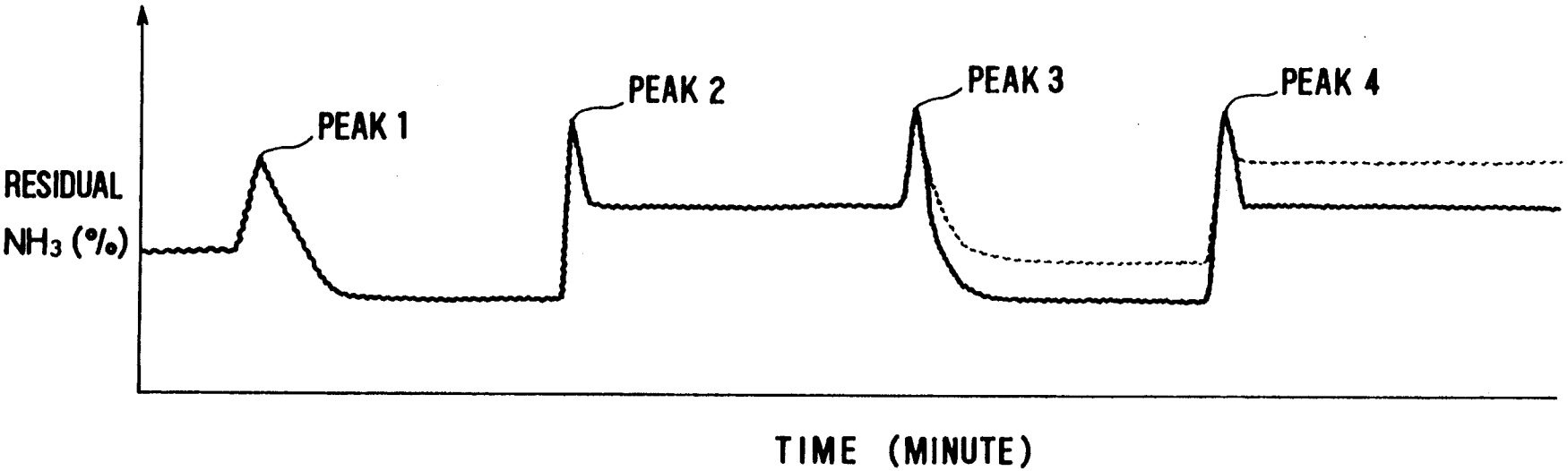
FIG. 7 is a diagram illustrating the relationship between a time elapsed and a residual gas wherein an object is nitrided according to the heat-treating apparatus of the present invention.

Next, when the bringing-in door 14A is opened and the conveyance of the object from the temperature re-up chamber 24 to the temperature down chamber 26 is finished, the bringing-in door 14A is closed and a predetermined amount of the carbonitriding gas is supplied to the temperature down chamber 26 from the $NH_3$ gas supplying means 56 so that the object is nitrided, while dropping its temperature in the carbonitriding gas atmosphere. Thus, as shown in the peak 2 in FIG. 7, the residual $NH_3$ gas increases rapidly by supplying the carbonitriding gas. As the time passes, the $NH_3$ gas is resolved into N and $H_2$, and the residual $NH_3$ gas decreases.

Furthermore, when the object is finished dropping its temperature, the bringing-out door 14B is re-opened and the object is conveyed to the nitriding chamber 28. The bringing-out door 14B is closed after this conveyance is finished. The residual $NH_3$ gas increases rapidly, as shown in the peak 3 in FIG. 7, from the same reason as described in the prior step. As time passes, the $NH_3$ gas is resolved into N and $H_2$ and the residual $NH_3$ decreases.

Moreover, the bringing-in door 14A is re-opened so as to convey the object into the temperature down chamber 26 and the bringing-in door 14A is closed after this conveyance is finished, then a predetermined amount of the carbonitriding gas is supplied into the temperature down chamber 26 so that the object is nitrided, while dropping its temperature in the carbonitriding gas atmosphere. The residual $NH_3$ gas, as shown in the peak 4 in FIG. 7, increases rapidly from the same reason described above.

Thereafter, the residual $NH_3$ gas decreases. However, unless an action to reduce the residual $NH_3$ is taken, as shown in a dotted line in FIG. 7, the residual $NH_3$ after the peak 3 is greater than the residual $NH_3$ after the peak 1 and the residual $NH_3$ after the peak 4 is greater than the residual $NH_3$ after the peak 2.

Therefore, when the object is nitrided by utilizing the present heat-treating apparatus A, right after the peak 3, i.e., the conveyance of the object to the nitriding chamber 28 is finished and right after the bringing-out door 14B is closed, the passage opening/closing valve **66*a* in the temperature down chamber gas exhausting passage 66 is opened and the large mass of endothermic gas which is the carburizing gas is supplied from the endothermic gas inlet 54D** which is carburizing gas inlet means.

Thus, the residual $NH_3$ gas, which is in the temperature down chamber 26 as a carburizing zone, is purged by the endothermic gas and exhausted to the outside through a temperature down chamber gas exhausing passage 66. As shown in a full line in FIG. 7, the residual $NH_3$ gas after the peak 3 is approximately at the same level as the residual $NH_3$ gas after the peak 1. In accordance with this, the residual $NH_3$ gas after the peak 4 is approximately at the same level as the residual $NH_3$ gas after the peak 2.

As described above, according to the present heat-treating apparatus A, since the carburizing gas is supplied to the nitriding zone so as to purge the residual $NH_3$ gas in the nitriding zone and the residual $NH_3$ gas is exhausted to the outside, the residual $NH_3$ gas in the nitriding zone doesn't increase even the object is repeated being nitrided in the nitriding zone and accordingly, object of stable quality can be obtained.

In the present heat-treating apparatus A, the temperature down chamber 26 is provided between the temperature up chamber 24 and the nitriding chamber 28, however, the temperature down chamber 26 can be eliminated. When the temperature down chamber 26 is eliminated, a carbonitriding chamber gas exhausting passage should be provided in a carbonitriding chamber 28 in order to exhaust the residual $NH_3$ gas in the carbonitriding chamber 28 to the outside since the carbonitriding chamber 28 construct the nitriding zone.

Figure 8:
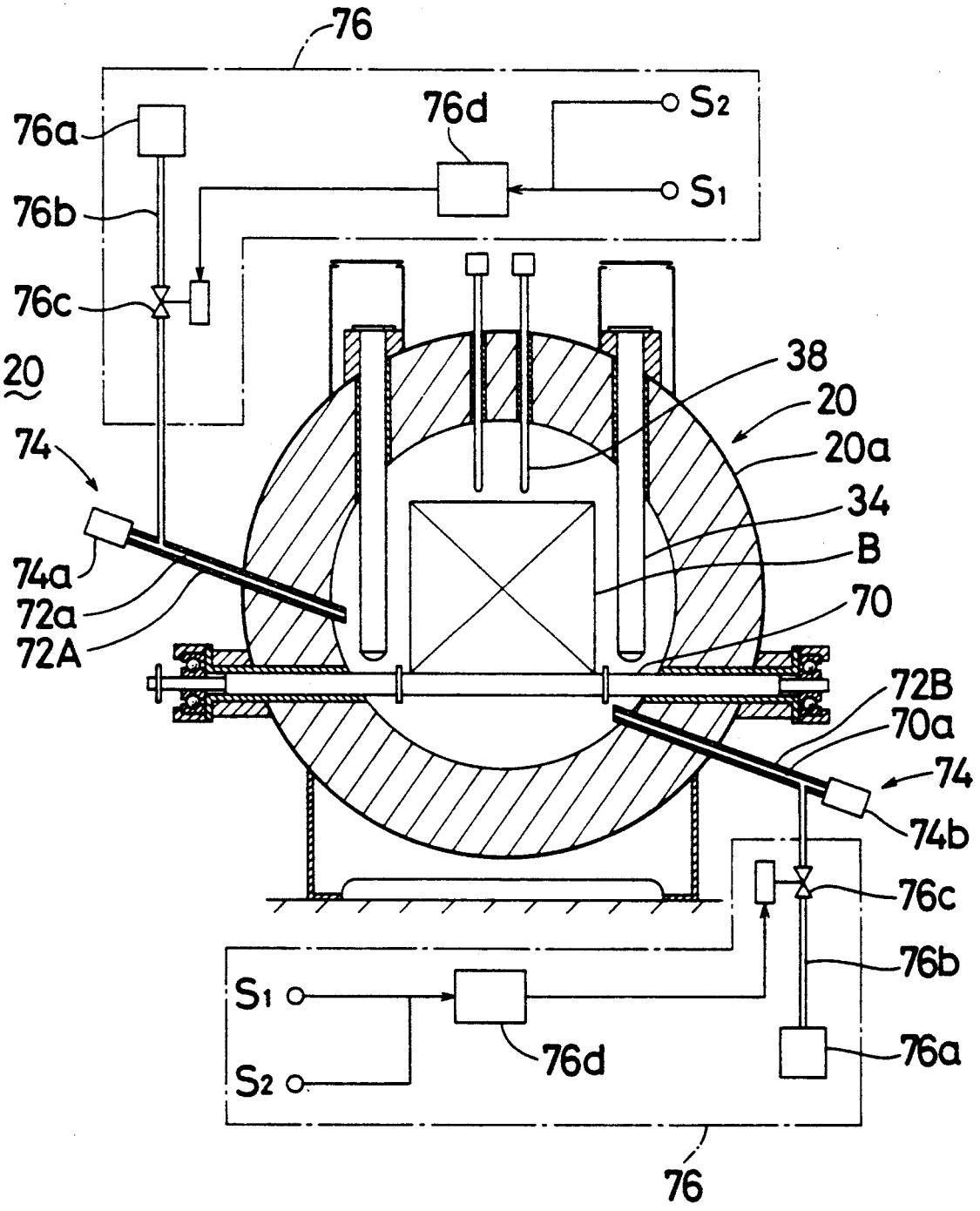
FIGS. 8 and 9 are transverse sectional views of a carburizing chamber of the present heat-treating apparatus.

FIG. 8 shows a transverse cross section of the aforementioned carburizing chamber 20, a power roller 70 which is a conveyor means having a power source transversely pierces the lower side of the furnace wall 20*a* of the carburizing chamber 20. The object B put on the power roller 70 is conveyed to zones in series.

Also, a pair of thermocouples 38 vertically piercing the furnace wall 20*a* are provided on the center top of the carburizing chamber 20, and a pair of electro tubes 34 vertically piercing the furnace wall 20*a* are provided on both upper right and left sides of the carburizing chamber 20.

Right and left heat resisting protector tubes 72A and 72B obliquely piercing the furnace wall 20*a* are provided on left and right side of the carburizing chamber 20, each protector tube 72A and 72B comprises a furnace wall hollow 72*a* therein.

A projector 74*a* of an opposed type photoelectric switch 74 which is a detector is provided on the external end part of the left protector tube 72A, and a receiver 74*b* of the photoelectric switch 74 is provided on the external end of the right protector tube 72B. The photoelectric switch 74 sends conveyance finishing signal $_{S1}$ when the beam from the projector 74*a* is interrupted by the object B, i.e., when the receiver 74*b* doesn't receive the beam even the projector 74*a* send the beam.

In each right and left protector tube 72A and 72B, inert gas supplying means 76 for supplying inert gas inside the furnace wall hollow 72*a* is provided. The inert gas supplying means 76 comprises an inert gas supplying source 76*a* for supplying the inert gas, for example, $N_2$ gas, an inert gas inlet passage 76*b* having each end connected to the inert gas supplying source 76*a* on the upper stream side and to the furnace wall hollow 72*a* on the down stream side, a passage opening/closing value 76*c*, disposed in the inert gas inlet passage 76*b*, for regulating the flow mass of the inert gas, and a timer 76*d* for opening the passage opening/closing valve 76*c* for a predetermined period of time, for example, five seconds, when the timer 76*d* receives the conveyance finishing signal $_{S1}$ or a door opening signal $_{S2}$ for opening the door 14 on the cooling chamber 22 side.

Since thus constructed inert gas supplying means 76 is connected to each left and right protector tube 72A, 72B, a foreign matter such as a medium accumulated in the furnace wall hollow 72*a* is removed by being purged by the inert gas supplied into the furnace wall hollow 72*a* when the passage opening/closing valve 76*c* is opened to supply the inert gas into the furnace wall hollow 72*a*.

Preferred timing for supplying the inert gas into the furnace wall hollow 72*a* and the timing for conveying the object B are described below.

The door 14 on the cooling chamber 22 side is opened to convey the object B to the cooling chamber 22 when carburizing the object B is finished in the carburizing chamber 20, and the door 14 on the cooling chamber 22 side is closed when the conveyance of the object B is finished. Then, by the door opening signal $_{S2}$ sent when the door 14 on the cooling chamber 22 side finish being closed in order to open the door 14 on the temperature up chamber 18 side, the door on the temperature up chamber 18 side is opened and the inert gas is supplied into the furnace wall hollow 72*a* of each left and right protector tube 72A and 72B so as to purge the foreign matter inside the furnace wall hollow 72*a*.

Next, when the opening finishing signal $_{S3}$ sent at the moment of finishing opening the door 14 on the temperature up chamber 18 side is received, the conveyance of the object B in the temperature up chamber 18 to the carburizing chamber 20 is started by driving the power roller 70, and also the detection for the object B by the photoelectric switch is started. When the object B is conveyed to a predetermined conveyance area, the beam from the projector 74*a* is interrupted and the conveyance finishing signal $_{S1}$ is sent. Then, the conveyance of the object B is finished by stopping the driving of the power roller 70 after receiving the conveyance finishing signal $_{S1}$.

Also, by the conveyance finishing signal $_{S1}$, the inert gas is supplied into the furnace wall hollow 72*a* of each left and right protector tube 72A and 72B so as to purge the foreign matter inside the furnace wall hollow 72*a* for a predetermined period of time which is set by the timer 76*d*. Thus, when the receiver 74*b* receives the beam from the projector 74*a*, the conveyance of the object B is in a trouble and accordingly, the power roller 70 is driven again to start the conveyance of the object B. On the other hand, when the receiver 74*b* doesn't receive the beam from the projector 74*a*, the conveyance of the object B is in a good condition and the door 14 on the temperature up chamber 18 starts being closed.

The inert gas supplied into the furnace wall hollow 72*a* is not limited to the $N_2$ gas, however, any gas such as Ar gas, He gas, and carbonitriding gas which don't affect the heat-treating of the object, for example, nitriding, can be used.

Also, the period of opening the passage opening/closing valve 76*c* can be any period of time if the inert gas doesn't affect the density of the controlled atmosphere.

Furthermore, the photoelectric switch 74 is not limited to the opposed type, but reflecting type can be used for it. When the reflecting type is used, one of the protector tube is not needed since only one photoelectric switch 74 is provided on either one of the left and right protective tubes 72A and 72B.

Figure 9:
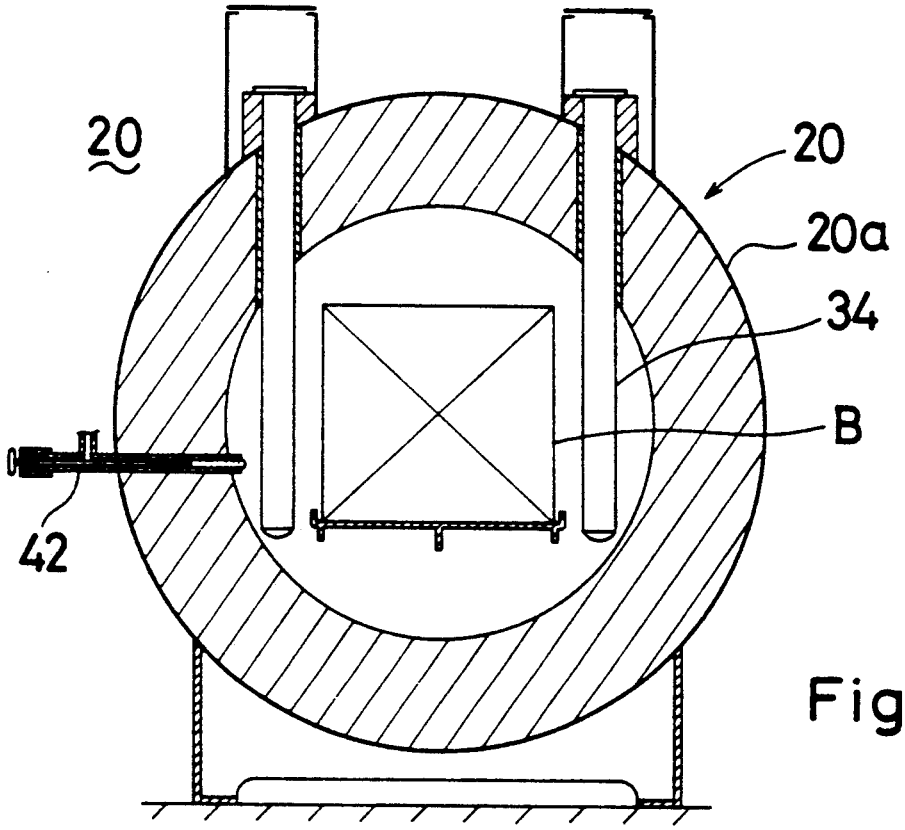
Figure 10:
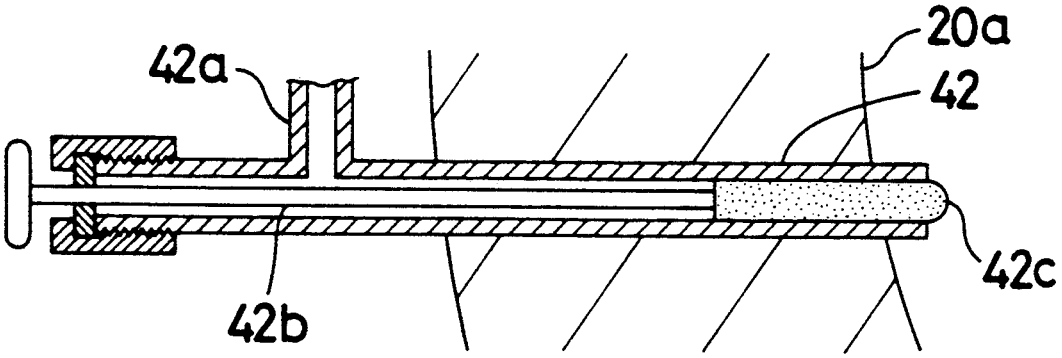
FIG. 10 is an enlarged sectional view of a part of the present carburizing chamber.

FIG. 9 shows the transverse cross section of the carburizing chamber 20 where a sample tube 42 is provided, and FIG. 10 shows the enlarged sectional view of the sample tube 42.

The sample tube 42 comprises a bifurcating tube 42*a* bifurcating and extending perpendicularly to the axis of the sample tube 42, a piston 42*b* sliding inside the sample tube 42, and a cleaner 42*c* disposed on the end of the piston 42*b*, the cleaner 42*c* cleans inside the sample tube 42 by sliding the piston 42*b* in the axis direction of the sample tube 42.

The conventional sample tube 42 is bent at its end, i.e., having L shape. Therefore, the operation of the heat-treating apparatus should be stopped and sample tube 42 is sample when inside of the sampel tube 42 is cleaned. However, according to the present heat-treating apparatus A, inside of the sample tube 42 is cleaned without stopping the operation and accordingly, the stability of the sampled controlled atmosphere and the better quality of the object B can be planned.

As described above, the heat-treating apparatus A comprises the inert gas supplying means 76 for supplying the inert gas into the furnace wall hollow 72*a* and therefore, the foreign matter inside the furnace wall hollow 72*a* can be purged by supplying the inert gas into the furnace wall hollow 72*a* timely. This results in easier and timely removing of the foreign matter which isolates the detector from the continuous furnace. Consequently, the bad detecting caused by the foreign matter inside the furnace wall hollow 72*a* is eliminated and the trouble during the conveyance of the object B can be detected timely and appropriately.

Figure 11:
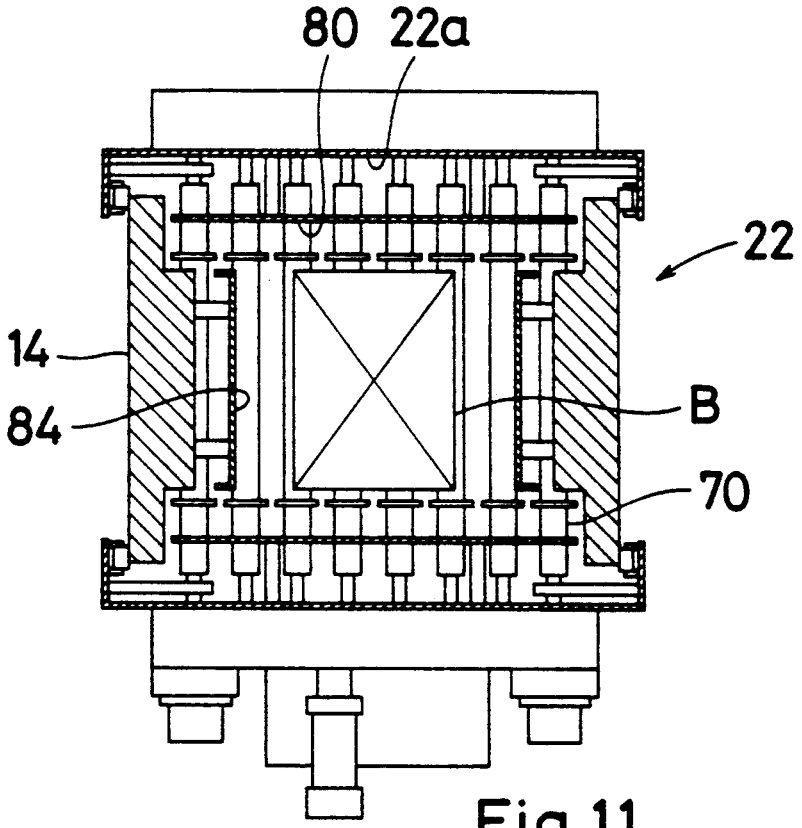
FIG. 11 is a plan view of a cooling chamber of the heat-treating apparatus according to the present invention.
Figure 13:
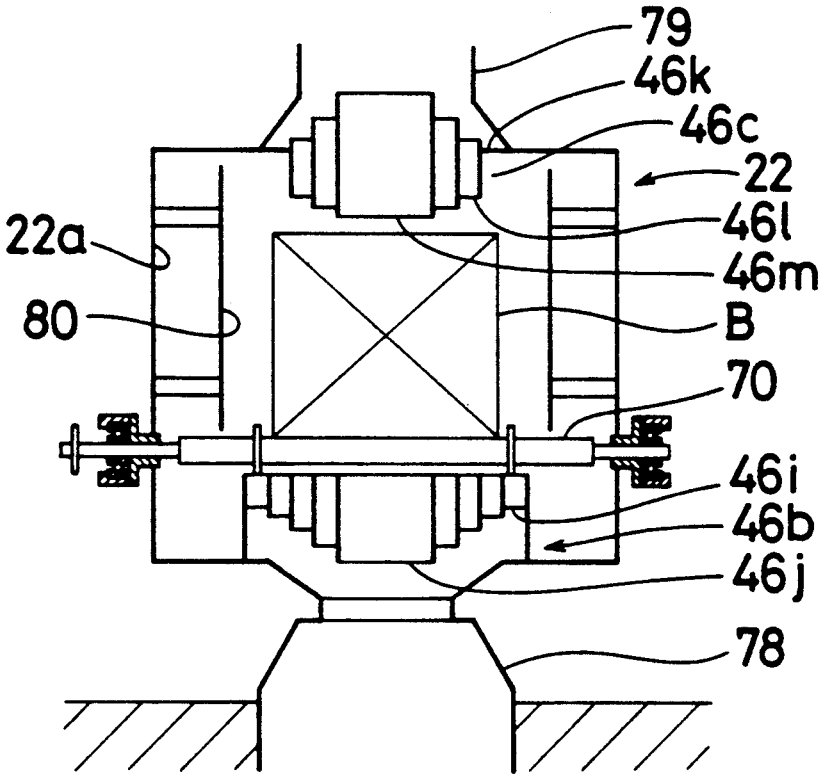
FIG. 13 is a transverse sectional front view of the cooling chamber in FIG. 11.
Figure 12:
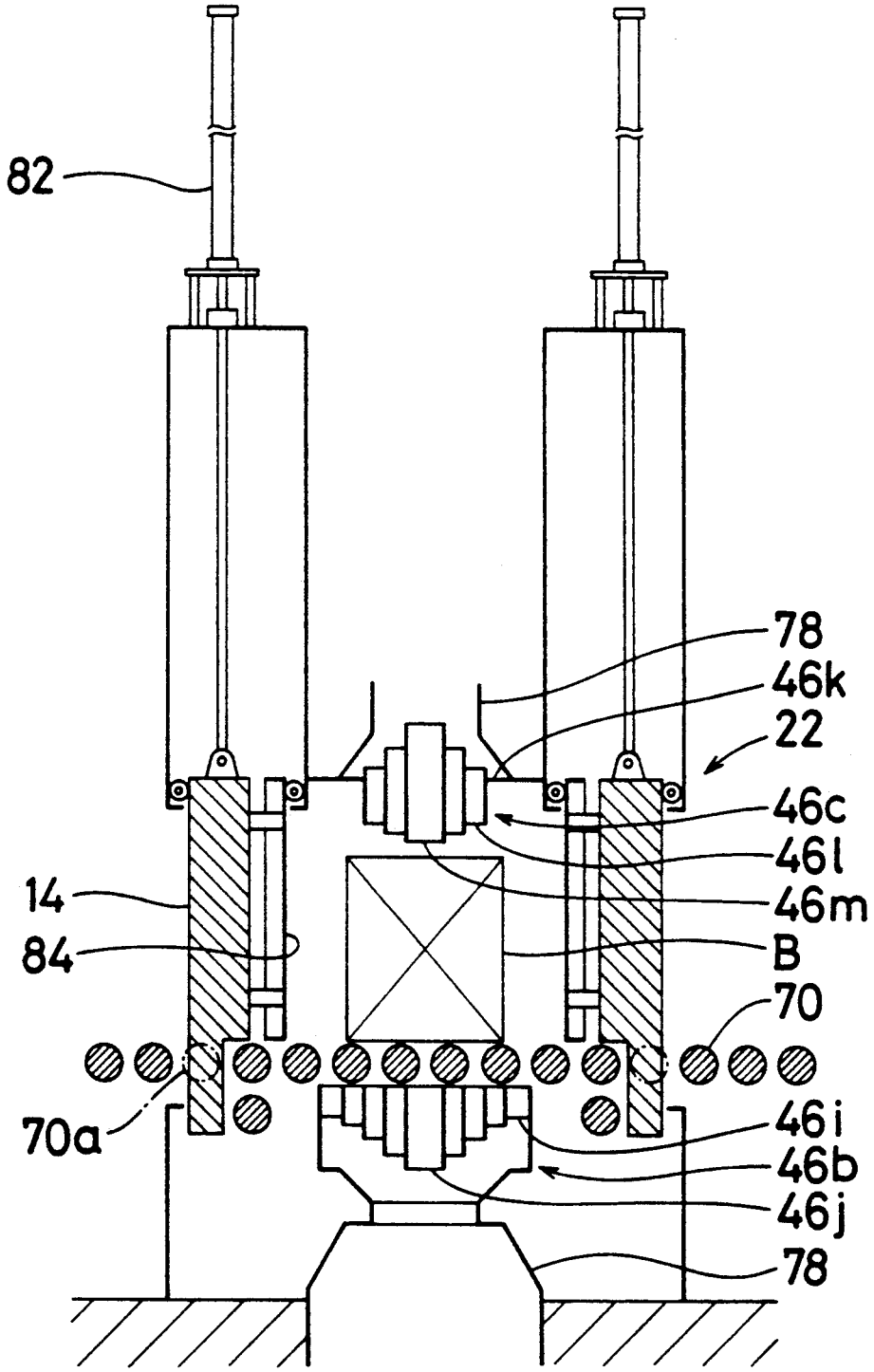
FIG. 12 is a longitudinal sectional side view of the cooling chamber in FIG. 11.

FIG. 11 shows a plan view of the cooling chamber 22, FIG. 12 shows a construction of longitudinal sectional view of the cooling chamber 22, and FIG. 13 shows a construction of transverse view of the cooling chamber 22. The object B is put on the power roller 70 and conveyed to the carburizing chamber 20 through the decarburizing chamber 16 and the temperature up chamber 18. In the carburizing chamber 20, the object is carburized and conveyed from the left to the right in FIG. 11, then set on approximately center of the cooling chamber 22.

The cooling gas blowing duct 46*b* is provided below the object B which is set in the cooling chamber 22, concretely, just below the power roller 70. The cooling gas blowing duct 46*b* is composed of five tubes disposed coaxially, each tube having section of long truck configuration is perpendicular to the conveyance direction. The lower part of the outer wall of the outer tube 46*i* extends downwardly having conical configuration and communicates at the lower end of the outer tube 46*i* with the cooling gas circulating duct 78 for communicating the cooling gas blowing duct 46*b* and the cooling gas collecting duct 46*c*. The upper ends of the five tubes are set at the same level, while the lower ends project downwardly, the inner tube projects more than the outer tube one by one.

Since the lower ends of the cooling gas blowing duct 46*b* project more downwardly in the inner tube 46*j* than the outer tube 46*i*, i.e., projects to the upstream side of the cooling gas, the inner tube 46*j* can provide the cooling gas more in the commutation condition. Thus, the inner tube 46*j* can blow the cooling gas with high flow velocity, i.e., a large mass of cooling gas, to the object B. The cooling gas flowing through the object B posesses the large resistance and accordingly, slow velocity. However, according to the above constructed blowing duct 46*b*, the object B is cooled down rapidly and also, all the parts of the object B is cooled down evenly. Therefore, the deformation of the object B is hardly caused.

Figure 14:
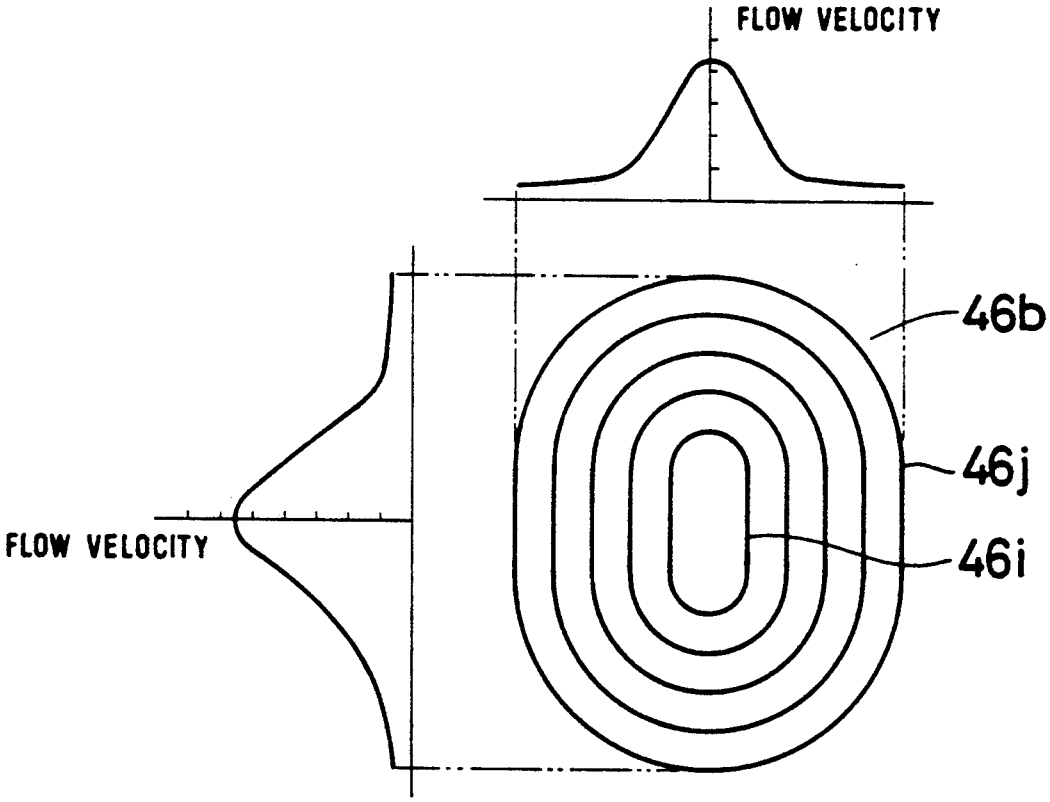
FIG. 14 is a diagram illustrating a flow velocity of cooling gas in the cooling chamber in FIG. 11.

FIG. 14 shows the relation between the sectional configuration of the cooling gas blowing duct 46*b* and the flow velocity of the cooling gas. For both the direction of the conveyance of the object B and the direction perpendicular to the conveyance direction, the flow velocity of the cooling gas blown from the center of the blowing duct 46*b* is higher than that from the periphery of the blowing duct 46*b*.

The cooling gas collecting duct 46*c* is provided above the object B which is set in the cooling chamber 22, concretely, near the ceiling of the cooling chamber 22. The cooling gas collecting duct 46 faces to the cooling gas blowing duct 46*b* through the object B and connected to the cooling gas circulating duct 78 through the ceiling board 46*k*. The cooling gas collecting duct 46*c* is composed of three tubes disposed coaxially, each tube has section of long truck configuration perpendicular to the conveyance direction. Each tube is projecting in both upper and lower directions and the inner tube 46*l* projects to both directions more than the outer tube 46*m* one by one. The outer diameter of the cooling gas collecting duct 46*c* is a size smaller than that of the cooling gas blowing duct 46*b*.

Since the lower end of the inner tube 46*l* of the cooling gas collecting duct 46*c* projects more than the outer tube 46*m*, the center of the cooling gas collecting duct 46*c* is closer to the object B than the outer side. Therefore, the suction of the cooling gas collecting duct 46*c* for the cooling gas flowing through the object B is stronger than that for the cooling gas flowing outside of the object B. Although the flow velocity of the cooling gas flowing through the object is lower because of the higher resistance, the present heat-treating apparatus A has the approximately same cooling strength for both inside and the outside of the object B since the suction of the cooling gas collecting duct 46*c* affect the cooling gas flows through the object B.

Also, since the upper end of the inner tube 46*m* of the cooling gas collecting duct 46*c* is projecting more upwardly than the outer tube 46*l* and inner side of the cooling gas collecting duct 46*c* has stronger suction, the cooling gas flowing through the object B is absorbed strongly.

As shown in FIGS. 11 and 13, between the power roller 70 and the ceiling board 46*k*, fixed wall members 80 of a thermal reflecting board are provided on the both sides of the object B in the cooling chamber 22, which is also in the outside of the cooling gas blowing duct 46*b*. The fixed wall members 80 are supported by the wall 22*a* of the cooling chamber 22 inside the wall 22*a*.

As also shown in FIG. 12, the door 14 supported movably in the vertical direction by a hydraulic cylinder 82 is provided on each end of the cooling chamber 22 in the conveyance direction. Between the power roller 70 and the ceiling board 46*k*, a movable wall member 84 of a thermal reflecting board is provided inside of the door 14, which is also outside of the cooling gas blowing duct 46*b*. The movable wall member 84 is supported by the door 14 inside of the door 14.

The thermal reflecting board constructing the above fixed wall member 80 and the movable wall member 84 is preferably composed of such materials like a stainless steel board which possesses high thermal reflecting rate and low thermal capacity.

When the fixed wall members 80 and the movable wall members 84 are composed of the thermal reflecting board in this way, the periphery of the object B having lower resistance of the cooling gas and easy to cool slows its cooling speed by the radiant heat from the thermal reflecting board. Thus, it is balanced out with the center part of the object B which possesses the larger resistance of the cooling gas and hard to cool. As a result, the object B is cooled evenly and the product of high quality can be obtained.

A muffle for covering space between opening of the cooling gas blowing duct **46*b* and opening of the cooling gas collecting duct 46*c* is formed by the fixed wall member 80 and the movable wall member 84. The inner periphery of the muffle is a little larger than the outer periphery of the cooling gas blowing duct 46*b*, and the height of the muffle is a little shorter than the height from the power roller 70 to the ceiling board 46*k***.

When the door 14 moves downwardly, the power roller **70*a* disposed below the door 14 swings inwardly so that the power roller doesn't interrupt the door 14**.

As described so far, the cooling gas from the cooling gas blowing duct **46*b* flows to the cooling gas collecting duct 46*c* directly by being regulated by the fixed wall member 80 and the movable wall member 84, both composing the muffle and therefore, the cooling gas cools the object B effectively. The doors 14 are provided on both ends of the cooling chamber 22 in the conveyance direction and the walls of the cooling chamber 22 are rough, however, the space where the cooling gas flows is smooth by the muffle. Thus, the flow velocity of the cooling gas is not affected by the door 14**.

Figure 15:
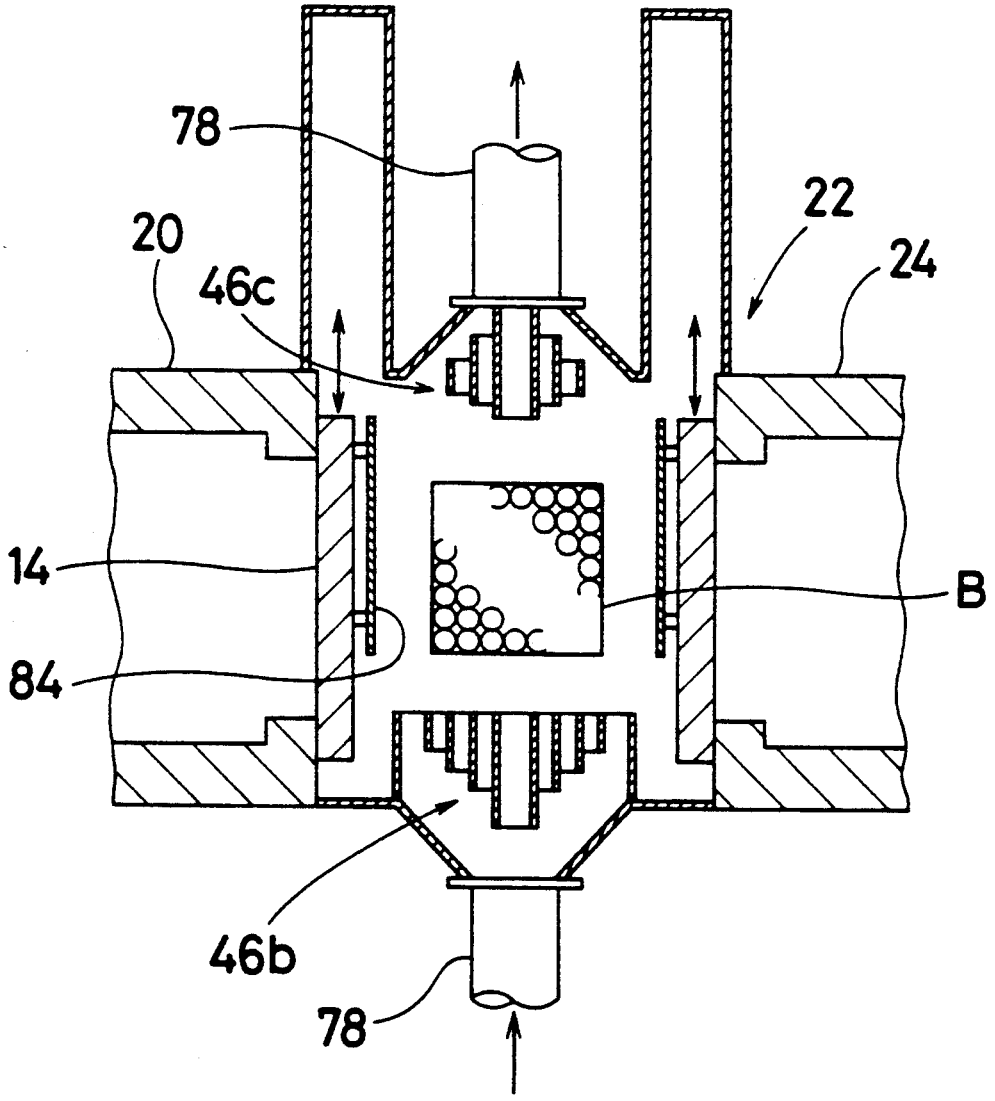
FIG. 15 is a longitudinal sectional side view of a cooling chamber having gas cooling means as a modified embodiment.
Figure 16:
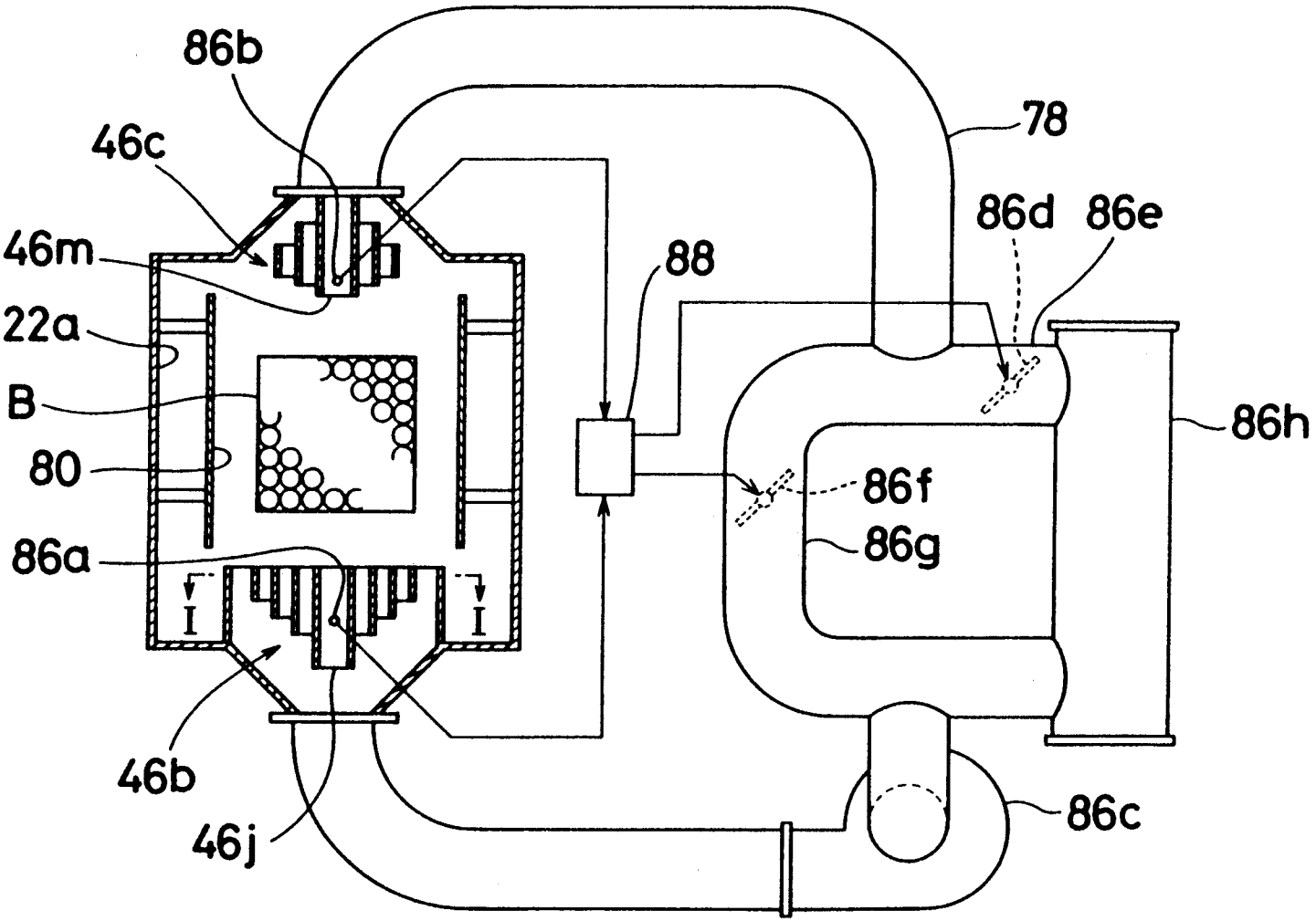
FIG. 16 is a longitudinal sectional side view of the gas cooling means as a modified embodiment in FIG. 15.
Figure 17:
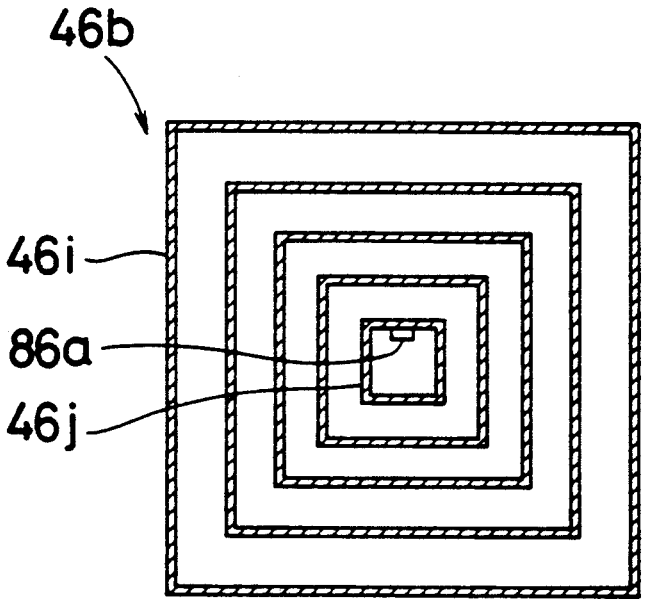
FIG. 17 is a sectional view taken on line I—I of FIG. 16.

FIGS. 15–17 illustrate the gas cooling means 86 which is a modified embodiment of the above gas cooling means 46 provided in the cooling chamber 22. This gas cooling means 86 comprises hereinafter described temperature regulating means 88.

FIG. 15 is illustrating the longitudinal sectional side view of the cooling chamber 22 having the above gas cooling means 86. The door 14, the movable wall member 84, the cooling gas blowing duct **46*b*, the cooling gas collecting duct 46*c*, and the cooling gas circulating duct 78** are the same as the aforementioned ones in the basic function.

FIG. 16 is a plan view of the cooling means 86. The cooling means 86 comprises a first temperature sensor **86*a* inside the inner tube 46*j* of the cooling gas blowing duct 46*b*, a second temperature sensor 86*b* in the inner tube 46*m* of the cooling gas collecting duct 46*c*, and a circulating blower 86*c* in the cooling gas circulating duct 78. The cooling gas circulating duct 78 is bifurcated into a first circulating duct 86*e* having a first flow mass regulating valve 86*d* and a second circulating duct 86*g* having a second flow mass regulating valve 86*f*. The first circulating duct 86*e* comprises a gas cooler 86*h***.

The temperature regulating means 88 is for controlling the first and the second flow mass regulating valves **86*d*, 86*f* by receiving the temperature signal from the first and the second temperature sensor 86*a*, 86*b*. The control of the temperature regulating means 88** is described below.

When the door 14 between the carburizing chamber 20 and the cooling chamber 22 is opened to bring the object B into the cooling chamber 22, the temperature of the object B is high and the temperature of the cooling gas inside the cooling gas circulating duct 78 is low. Therefore, the temperature detected by the first temperature sensor **86*a* is low, and the temperature detected by the second temperature sensor 86*b* is high. Accordingly, the temperature regulating means 88 closes the first flow mass regulating valve 86*d*, while opening the second flow mass regulating valve 86*f*, so that the cooling gas is supplied only from the second circulating duct 86*g***. The periphery of the object B is cooled by the radiant heat and the center of the object B is cooled by the radiant heat and the convection.

When the object B is cooled, the temperature detected by the first and the second temperature sensors **86*a*, 86*b* are high. The temperature regulating means 88 opens the first and the second flow mass regulating valves 86*d*, 86*f* so that the cooling gas is supplied from both the first and the second circulating ducts 86*d*, 86*g*. The cooling rate is improved if the temperature of the cooling gas is regulated by the temperature detected by the first temperature sensor 86*a***.

Figure 18:
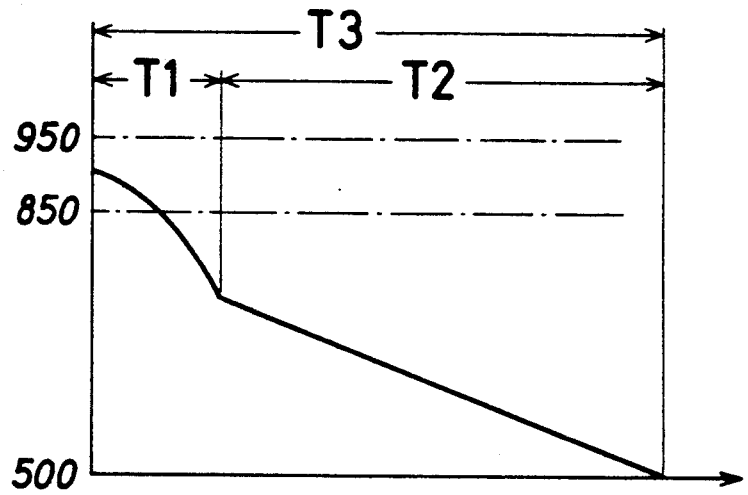
FIG. 18 is a diagram illustrating a relationship between a processing time by the gas cooling means as a modified embodiment in FIG. 15 and a temperature of an object.
Figure 19:
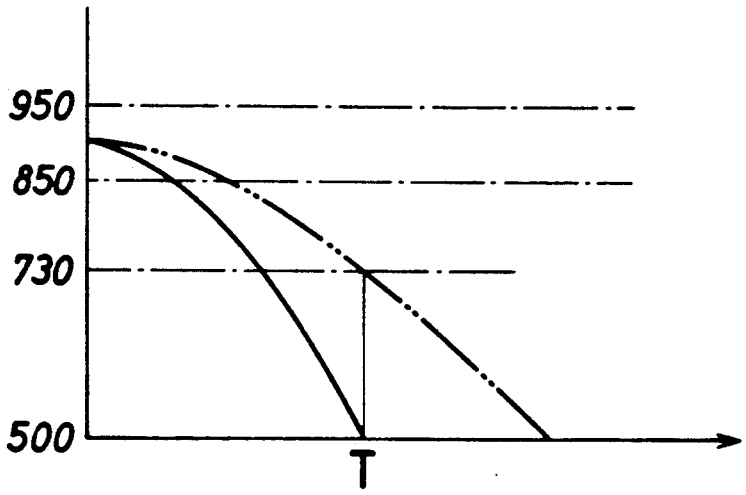
FIG. 19 is a diagram illustrating a processing time of the gas cooling means as a modified embodiment in FIG. 15 and that of conventional gas cooling means.
Figure 20:
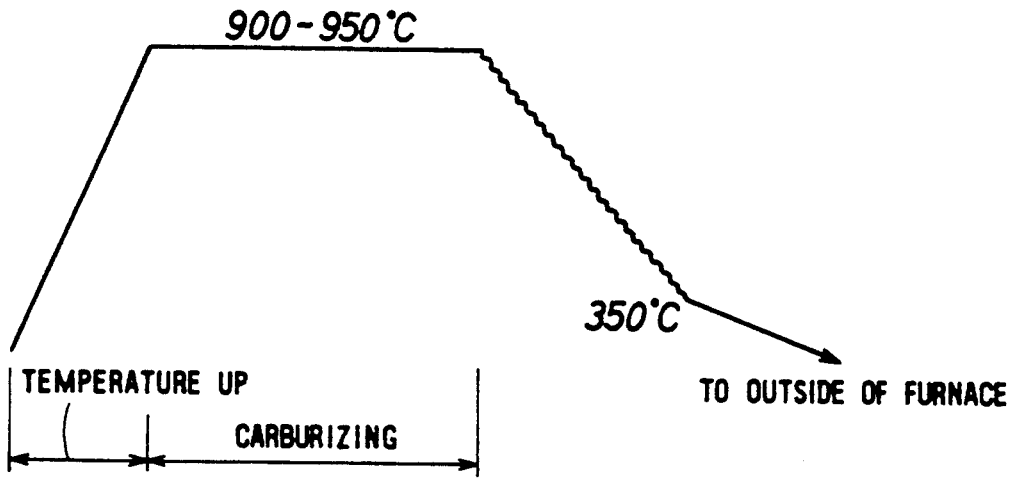
FIGS. 20 and 21 are diagrams illustrating heat-treating cycles according to a conventional heat-treating apparatus.
Figure 21:
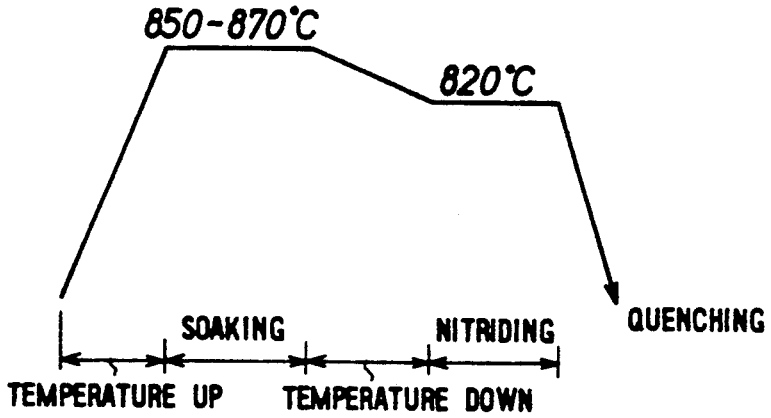

FIG. 18 illustrates the relationship between the processing time and the temperature of the object B wherein the spherical carbide on the surface of the object B is appropriately regulated by cooling the object B, which is finished being carburized in the carburizing chamber 20, in the cooling chamber 22. Preferable way of regulating the whole cooling time (T3) is such that cooling rapidly in the first cooling time (T1) and cooling slowly in the latter cooling time (T2). By this way, as shown in FIG. 19, the processing time for cooling (T) can be shortened, comparing to the conventional way (shown in the alternate long and two short dashes line).

What is claimed is:

1. A heat-treating apparatus comprising:

a first heat-treating zone for heat treating an object in controlled atmosphere;

a cooling zone for cooling the object, which finished being heat-treated in said first heat-treating zone, by cooling gas; and a second-treating zone for heat-treating the object, which finished being cooled in said cooling zone, in controlled atmosphere, said heat-treating zones and said cooling zone communicate through a door.

2. A heat-treating apparatus comprising:

a carburizing zone for heating and carburizing an object, a cooling zone for cooling the heated and carburized object, and a nitriding zone for heating and nitriding the object, said zones are formed in series by partitioning a continuous passage through openable and closable doors;

conveyor means for conveying an object along said continuous passage; and said cooling zone comprises a forced-feed gas cooling means for cooling the object by blowing cooling gas to the object said forced-feed cooling means comprising a cooling gas blowing duct for blowing a cooling gas to the object; and a cooling gas collecting duct for collecting the cooling gas blown to the object.

3. A heat-treating apparatus as claimed in claim 2, further comprising:

a temperature re-up zone, provided between said cooling zone and said nitriding zone, for heating the object in carburizing gas atmosphere;

a bypass for communicating said temperature re-up zone with said nitriding zone so that carburizing gas flows therebetween; and air flow forming means for forming air flow that makes the carburizing gas of said temperature re-up zone flow to said nitriding zone through at least either a communicating part between said temperature re-up zone and said nitriding zone or said bypass.

4. A heat-treating apparatus as claimed in claim 2, wherein said nitriding zone comprises:

nitriding gas inlet means for making nitriding gas flow into said nitriding zone;

carburizing gas inlet means for making carburizing gas flow into said nitriding zone; and exhausting means for exhausting residual ammonia in said nitriding zone to an outside.

5. A heat-treating apparatus as claimed in claim 2, which is a tunnel type continuous furnace and further comprises:

a furnace wall hollow piercing a furnace wall of said continuous furnace;

conveyance detecting means for detecting conveyance of the object through said furnace wall hollow;

a door actuator for actuating the doors when the conveyance detecting means detects the conveyance of the object; and inert gas supply means for supplying inert gas to said furnace wall hollow.

6. A heat-treating apparatus as claimed in claim 2, wherein said cooling zone further comprises:

pressure regulating means for regulating pressure inside said cooling zone.

7. A heat treating apparatus as claimed in claim 6, wherein said cooling gas is cooled carbonizing gas and said pressure regulating means comprises:

a first passage for supplying a large mass of said carburizing gas to said cooling zone;

a second passage for supplying a small mass of carburizing gas to said cooling zone;

a pressure sensor for detecting pressure inside said cooling zone; and control means, by receiving signals from said pressure sensor, for supplying said carburizing gas from said second passage if pressure inside said carburizing zone is less than a predetermined level and for supplying said carburizing gas from said first passage if pressure inside said carburizing zone is not less than a predetermined level.

8. A heat-treating apparatus as claimed in claim 2, wherein said forced-feed cooling means comprises:

a cooling gas blowing duct for blowing the cooling gas to the object; and a cooling gas collecting duct for collecting the cooling gas blown to the object, each duct is composed essentially of multiple tubes and faces to each other through a position where the object is set in said cooling zone.

9. A heat-treating apparatus as claimed in claim 8, wherein said cooling gas blowing duct comprises 5 tubes disposed coaxially, each of said tubes from the outer tube to the inner tube extending in a progressively downward direction forming a frusto-conical configuration.

10. A heat-treating apparatus as claimed in claim 8, wherein said cooling gas collecting duct comprises 3 tubes disposed coaxially, each of said tubes from the outer tube to the inner tube extending in a progressively downward direction forming a first frusto-conical configuration and each of said tubes from the outer tube to the inner tube extending in a progressively upward direction forming a second frusto-conical configuration.

11. A heat-treating apparatus as claimed in claim 8, wherein said forced-feed cooling means further comprises:

cooling gas supply means for supplying cooled gas to said cooling gas blowing duct after cooling said cooling gas collected through said cooling gas collecting ducts;

noncooling gas supply means for supplying said cooling gas collected through said cooling gas collecting duct to said cooling gas blowing duct without cooling said cooling gas;

control means for supplying the cooling gas from said noncooling gas supply means if a temperature of said cooling gas blown from said cooling gas blowing duct, detected by said temperature sensor, is not more than a predetermined level and for supplying said cooling gas from said cooling gas supply means if a temperature of the cooling gas blown from said cooling gas blowing duct, detected by said temperature sensor, is more than a predetermined level.

12. A heat-treating apparatus as claimed in claim 8, wherein fixed wall members are provided on both inner sides of opposing walls in said cooling zone and movable wall members are provided inside both doors on both ends of said continuous passage in a conveyance direction, said both fixed wall members and movable wall members cover space between said cooling gas blowing duct and said cooling gas collecting duct.

13. A heat-treating apparatus as claimed in claim 12, wherein said fixed wall members and said movable wall members are composed of thermal reflecting boards.

14. A heat-treating apparatus comprising:

a first heat-treating zone for heat-treating an object in controlled atmosphere;

a cooling zone for cooling said object, which finished being heat-treated in said first heat-treating zone, by cooling gas; and a second heat-treating zone for heat-treating the object, which finished being cooled in said cooling zone in controlled atmosphere, said heat-treating zones and said cooling zone communicate through a door, said cooling zone comprises pressure regulating means for regulating pressure inside said cooling zone so that the pressure is at a desired value.

15. A heat-treating apparatus comprising:

a heating zone for heating an object in carburizing gas atmosphere;

a nitriding zone for nitriding the object, which finished being heated in said heating zone, in nitriding gas atmosphere, said nitriding zone comprises nitriding gas inlet means for making nitriding gas flow into said nitriding zone, carburizing gas inlet means for making carburizing gas flow into said nitriding zone, and exhausting means for exhausing residual ammonia in said nitriding zone to an outside;

a communicating part for communicating said heating zone with said nitriding zone so that the object can be conveyed therebetween; and a door for opening and closing said communicating part.

* * * * *